US005627903A

United States Patent [19]

Porrazzo et al.

[11] Patent Number: 5,627,903

[45] Date of Patent: May 6, 1997

[54] VARIABLE GEOMETRY ELECTROMAGNETIC TRANSDUCER

[75] Inventors: Edward M. Porrazzo; Karen P. Orell-Porrazzo, both of Citrus Heights, Calif.

[73] Assignee: Chain Reactions, Inc., Gold River, Calif.

[21] Appl. No.: 132,652

[22] Filed: Oct. 6, 1993

[51] Int. Cl.[6] ..... H04R 25/00

[52] U.S. Cl. ..... 381/202; 381/203

[58] Field of Search ..... 381/190, 202, 381/192, 196, 199, 203

[56] References Cited

U.S. PATENT DOCUMENTS

| | | | |
|---|---|---|---|
| 1,403,849 | 1/1922 | Delany . | |
| 4,276,449 | 6/1981 | Sawafuji | 381/196 |
| 4,322,698 | 3/1982 | Takahashi et al. | 333/184 |
| 4,491,698 | 1/1985 | Larson et al. | 381/203 |
| 4,544,806 | 10/1985 | Nieuwendijk et al. . | |
| 4,699,242 | 10/1987 | Ono . | |
| 4,782,471 | 11/1988 | Klein | 381/190 |
| 5,430,805 | 7/1995 | Stevenson et al. | 381/196 |

FOREIGN PATENT DOCUMENTS 57-30497 2/1982 Japan .

*Primary Examiner*—Sinh Tran

*Attorney, Agent, or Firm*—Townsend and Townsend and Crew; Guy W. Chambers

[57] ABSTRACT

A variable geometry transducer diaphragm having an electrical conductor layer, with a conductor pattern, is positioned on an insulating layers. Magnets used to create an electromagnetic field around the conductors may be placed in the insulating layer or formed as part of the frame supporting the diaphragm. Alternatively, the frame may be constructed to function as plates of a capacitor creating an electrostatic field around the diaphragm.

26 Claims, 17 Drawing Sheets

VARIABLE GEOMETRY ELECTROMAGNETIC TRANSDUCER

BACKGROUND OF THE INVENTION

This invention relates to electromagnetic transducers and in particular to electromagnetic transducers of variable and nonspecific geometry.

Contemporary recording techniques enable the full dynamic range of musical performances to be captured, stored, and replayed at a later time. No longer esoteric technologies, consumers have enjoyed increasing access to these recording innovations in the form of stereo televisions, compact discs and digital tape. These improved recordings and transmission technologies, however, highlight the shortcomings existing technologies have in making the transfer between the representation of sound as an electrical/digital signal and as a mechanical vibration perceivable to the human ear. Furthermore, the miniaturization and portability of modern devices have placed additional demands on sound reproduction technology. The transfer between sound as an electrical signal and a mechanical vibration must now take place not only with improved fidelity, but within the limitations of confined spaces.

Conversion of an electrical signal to audible mechanical energy typically involves use of an electromotive force to vibrate a membrane. As the magnitude and/or direction of the electromotive force changes in synchronization with the audio signal, the membrane is excited, producing mechanical vibrations perceivable as sound. The magnitude of the electromotive force, the distance of the force to the moving element and the size and responsiveness of the moving element all influence the frequency response, dynamic range and distortion characteristics of the particular acoustical device corresponding technology. Previous technologies, such as cone speakers, ribbon speakers and planar magnetic speakers have suffered from fixed and distinct geometries that define the relationship between the origin of the electromotive force and the vibrating elements. These fixed geometries impose various limitations on the frequency response, performance characteristics, costs, and miniaturization potential of the given reproduction technology.

Cone speakers, for example, include a large permanent magnet placed at the rear of a vibrating cone element typically formed of paper. Cone speakers take an electronic audio signal from the amplifier and convert it into a magnetic field. The magnetic field interacts with the field of the permanent magnet to create a force that pushes and pulls the cone or diaphragm back and forth to vibrate the air and produce sound.

Although cone speakers have the advantage of highly directed sound, the frequency response of the cone is limited by the size of the vibrating element or cone. Thus, an individual cone speaker cannot reproduce sound efficiently over the full audio spectrum and several cones of different sizes are required to adequately cover the spectrum. In addition, the geometric relationship of the cone to the magnet permits operation in only one direction. The cone speaker is pushed forward by the permanent magnet and then snaps back. The return motion induces an electrical signal which is sent down the speaker cable back to the amplifier. In extreme cases, the listener hears these return signals as distortion. The predefined shape of the cone speaker also consumes a fixed volume of area and limits the locations in which the speaker may be placed. The paper cone further limits the environment in which the speaker can be placed.

Other speaker designs include planar magnetic speakers and ribbon speakers. The planar magnetic speaker consists of a flat, thin film diaphragm fitted with a voice coil and held taught in a metal frame. On the front of this frame is a large sheet of perforated material to which a row of vertically aligned strip magnets has been fastened. The coils are thus suspended in a stationary magnetic field. The coil moves back and forth within the field in synchronization with the music signal, vibrating the diaphragm and producing sound.

The geometric relationship of the vibrating diaphragm to the permanent magnets also imposes limitations on the planar magnetic speaker performance. For example the planar magnetic speaker is not a pushpull device. As the diaphragm is excited it is driven into the opposing magnetic field and away from its optimum position. Distortion and muddy tone can result. These speakers also suffer from an inability to drive them linearly with a correspondingly unsatisfactory dynamic range.

The fixed geometry of the planar magnetic speakers also imposes various manufacturing and cost difficulties. The planar speaker must remain flat. Also, in part because of the distance of the magnets from the diaphragm, the magnets used in assembly of such speakers are typically quite large in order to generate the relatively strong magnetic fields desired. This characteristic makes assembling the magnets in the speaker frame especially difficult. Once positioned in the frame, the magnets are usually secured in place. However, a strong enough attraction between magnets positioned on opposite sides of the diaphragm may occasionally free a magnet from its secured position during speaker assembly. The freed magnet then accelerates through the diaphragm, tearing it and completely destroying the speaker. The ferrous support frame exacerbates the difficulties of manipulating the large, powerful magnets and securing them within the frame. The large frame and magnets required also prohibit the miniaturization of the device for use in home and/or portable electronics devices.

A ribbon speaker contains a long narrow strip of conductive material usually formed of a piece of corrugated aluminum. The ends of this strip are connected to the audio amplifier and are physically anchored to the frame such that the strip is suspended within the magnetic field. As the audio signal passes through the foil, the strip moves within the magnetic field and produces sound.

The ribbon speaker does not reproduce low frequency sound. To reproduce sound at low frequencies, the opposing magnets must be moved so far apart that they no longer exert a sufficient magnetic field over the entire ribbon area. The ribbon driver is thus limited by the existing geometric relationship between the vibrating element and the electromotive force.

Alternate technologies use an electrostatic force instead of magnetic force as the electromotive element. One such design is the electrostatic speaker. The electrostatic speaker includes a diaphragm suspended in a rigid frame between two charged plates called stators. In an electrostatic speaker, as the amplifier produces a continuously varying AC voltage representing the audio information, the charge on the two stators undergoes a corresponding change. The constant charge diaphragm thus undergoes a change in attraction to and repulsion from the two stators as their polarization changes. This motion produces sound.

Electrostatic speakers can also suffer from limitations imposed by the fixed geometric relationship between the electromotive force and the vibrating element. Most electrostatic speakers are prone to arcing. Arcing is a condition of stress in which dielectric breakdown occurs and an electrical spark jumps between one stator and the diaphragm, burning a minute hole in the diaphragm. Overtime, arcing destroys the speaker.

SUMMARY OF INVENTION

The transducer of the present invention forms the electromotive force as more integral to the moving element than in previous prior art designs. Integration of the magnet with the moving element provides the highest influence and cohesion to the inverse square law allowable. The coil is thus always optimally in the best possible location in the magnetic field since the magnetic field and the diaphragm are integrated components. In the present invention the integration of the magnetic and moving elements permits construction of a true, push-pull, bi-polar radiating transducer. Since the signal can be optimally processed and transduced in either the push and/or the pull direction, the feedback and other distortions inherent in prior art devices is difficult to induce. The transducer of the present invention may also be free formed to various shapes and geometries. The ability to free form the transducer shape permits the transducer to be located in previously unavailable geometries and configurations. For example, the transducer of the present invention may be shaped to fit around existing electronic components or other obstructions.

According to one embodiment of the invention, the magnets for creating the electromagnetic field in which the transducer operates, may be placed in the moving element itself. In this manner, large supporting structures for the magnets may be eliminated, thereby enabling a transducer of variable geometry reducing the expense of the transducer and also removing the complexities of assembly and permitting miniaturization. Furthermore, the magnets need not be as large to create the desired fields of magnetic flux. The transducer may also have multiple layers of coils and magnets each separated by insulating layers.

According to another embodiment of the present invention, the voice coils within the moving element may themselves be magnetized. In this fashion, the need for an additional magnet component in the transducer is eliminated. Further improvements in manufacturability and transducer efficiency are thereby attained.

According to yet another embodiment of the present invention, the magnetic influence is formed integral to the frame supporting the diaphragm. The frame is charged such that a top portion of the frame has a first charge and a bottom portion of the frame has a second charge. This construction also eliminates the separate magnet components, associated fixed geometry, corresponding supporting structures and associated assembly complexities that limit the placement and performance of prior art devices.

According to still another embodiment of the present invention, the charged frame structure is combined with the structure having magnets in the insulating layer. This construction provides further reductions in frame size, weight, and cost while providing a more efficient magnetic field in which the diaphragm can operate.

According to yet still another embodiment of the present invention, the top and bottom of the magnetized frame, function as the positive and negative plates of a capacitor. In this manner, the diaphragm of the present invention operates in an electrostatic field. In the present invention, the gap of typical electrostatic speakers is eliminated and arcing is reduced.

According to an additional embodiment of the present invention, the ability to free form the shape of the transducer permits the transducer to be shaped as a sphere having a magnet as a point source in the center. The resulting structure is an ideal speaker having a point source and equidistant influencing element.

The electromagnetic transducer disclosed herein may also include an additional layer of insulating material over the conductors. This layer provides protection of the conductors against oxidation or other environmental damage, thereby permitting the transducer to operate in a wider range of environments, such as high humidity or corrosive atmospheres. The insulating layer also protects against mechanical damage, such as abrasion, to the conductors and prevents open circuits in the conductive pattern. The additional layer of insulating material also prevents the conductors from contacting the magnet assembly or other conductive parts of the transducer, reducing the possibility of short circuits and eliminating potential shock hazards.

The insulating layer may also comprise multiple layers, and may be fabricated of different materials to control the resonant frequency of the diaphragm. Different regions of the diaphragm may be constructed to have different resonant frequencies to eliminate frequency response peaks. Similarly, the insulating layers can be used to minimize the effect of changes in ambient temperature on the diaphragm by selecting insulating materials having appropriate temperature coefficients.

DESCRIPTION OF THE PREFERRED EMBODIMENTS

Figure 1:
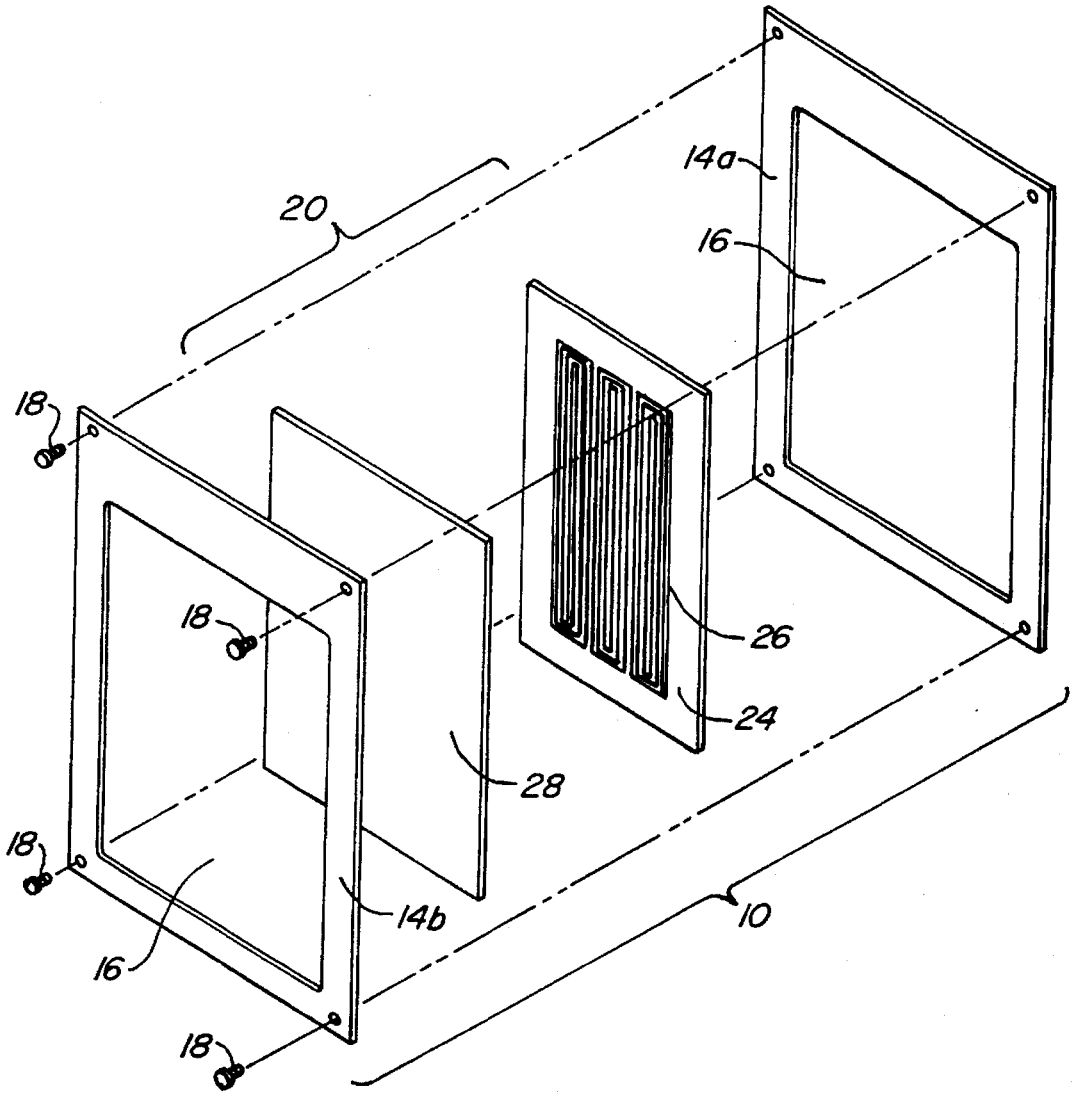
FIG. 1 is an exploded view of a transducer constructed according to an embodiment of the present invention.

FIG. 1 depicts an exploded view of the elemental components of an electromagnetic transducer 10 constructed according to one embodiment of the present invention. Each of the elemental components of FIG. 1 will be described in further detail below. Transducer 10 includes a support member or frame 14 which may be constructed of nonferrous materials, if desired. Fiberglass and plastic are two example materials suitable for constructing frame 14. In the exploded view of FIG. 1, frame 14 is shown constructed of two halves: 14*a* and 14*b*. Each frame half 14*a* and 14*b* includes soundholes or open area 16 which allow sound to radiate out from the transducer when used as a loudspeaker or permit sound energy to vibrate transducer 10 when used as a microphone. A series of bolts 18 or other suitable fasteners may used to secure the two frame halves 14*a* and 14*b* to each other. Optionally, the frame may be bonded together using techniques known in the art. In the embodiment of FIG. 1, frame 14 does not support any permanent magnets and is therefore lighter, more economical and more adaptable to miniaturization than prior art frame elements. The flat shape of the device also enables its use in flat screen televisions and other electronics goods where an unobtrusive speaker geometry is desirable.

Sandwiched between frame halves 14*a* and 14*b* is a diaphragm 20. Although diaphragm 20 is shown as rectangular in shape, diaphragm 20 may be any shape such as a circle, an ellipse, etc. As to be described below, diaphragm 20 also need not be flat, but may be convex or concave. In FIG. 1, diaphragm 20 is comprised of a first sheet 24 of pliable electrically insulating material. This material may be, for example, Kapton or Mylar or paper. Overlying sheet 24 is a series of voice coils 26, hereinafter also called electrical conductor layer 26. Conductor layer 26 also includes magnetized material to create an electromagnetic field in which to operate transducer 10. Construction of conductor layer 26 will be described in detail below. An insulating layer 28 also formed of flexible, pliable electrically insulating material overlies electrical conductor layer 26. Layer 28 may be formed of a film or a coating. Conductor layer 26 is thus shielded from the elements and does not lie on any exterior portion of the diaphragm. Optionally, insulating layer 28 may be omitted.

In operation, the transducer of the present invention operates by placing the diaphragm in an electromagnetic or electrostatic field. When an electrical current flows through the conductors, both magnetic and electrostatic fields develop around each conductor. These fields interact with the electromagnetic or electrostatic field in which diaphragm 20 is suspended, resulting in a force that displaces diaphragm 20 either toward the front or rear of transducer 10, depending on the direction and magnitude of the current flowing through conductor layer 26. This mechanical displacement of diaphragm 20 moves the surrounding air to create an acoustic signal corresponding to the electrical signal applied to conductor layer 26, so that transducer 10 acts as a loudspeaker. A smaller version of transducer 10 could be used in a headphone, hearing aid or an antenna as well as other miniaturized electronic components.

Without any structural changes, the transducers of the present inventions can also generate an electrical signal based on the displacement of diaphragm 20, as might be caused by acoustic or other vibrations from the surrounding air, permitting its use as a microphone or antenna. In this case, the movement of conductor layer 26 within the electrostatic or electromagnetic field induces a current flow in the conductor layer. To simplify discussion, only the mode of operation where an electrical input signal causes the displacement of diaphragm 20 is discussed, but it should be kept in mind that transducer 10 and the transducers discussed herein can also be used to generate an electrical signal such as used in, for example, a microphone or antenna.

Optimization of transducer efficiency may be had by providing a magnetic or electrostatic field of sufficient magnitude such that minimal current fluctuations in conductor layer 26 are necessary to produce the desired mechanical excursions of diaphragm 20. Optimization can be influenced, for example, by increasing the strength of the magnets to obtain a strong magnetic field and/or by varying the proximity of the magnets to the diaphragm. In prior art devices, using large fixed magnets incurs the need for substantial frame hardware to support the magnetic assembly. The powerful magnets also create difficulties in assembly and transducer placement as previously described. A frame structure containing magnets further limits the proximity of the magnets to the conductive elements and influences or fixes the frequency response and performance of the device. In addition, the fixed geometries of prior art cone, ribbon, planar and ribbon devices limit the performance characteristics and physical placement of those devices.

In accordance with the present inventions, the transducer of FIG. 1 is constructed such that permanent magnets used to create an electromagnetic field are included integral with diaphragm 20. This construction technique minimizes the size, weight and cost of frame 14. The transducer construction of the present invention therefore also enables further miniaturization of speaker and microphone elements. In addition, the construction of the present invention improves the electromagnetic efficiency of the transducer over prior art designs by eliminating the performance constraints of having the electromotive element located in a fixed and distinct geometric relationship apart from the vibrating element. The integration of the electromotive element with the vibrating element provides the highest influence and cohesion to the inverse square law allowable. The voice coil of the present invention is thus always optimally in the best possible location in the magnetic field since the magnetic field and the diaphragm are integrated components. In the present invention the integration of the magnetic and moving elements permits construction of a true, push-pull, bi-polar radiating transducer. Since the signal can be optimally processed and transduced in either the push or the pull direction, feedback and other distortions inherent in prior art devices are difficult to induce.

Figure 2A:
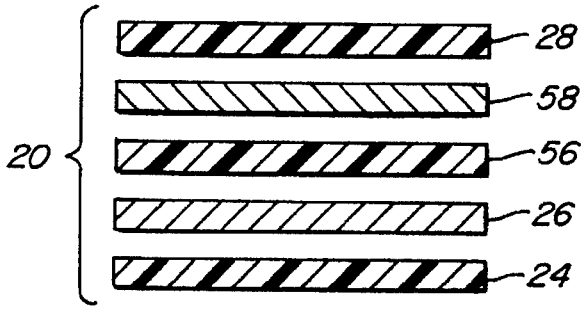
FIG. 2A is a cross-section of a diaphragm constructed according to an embodiment of the present invention.
Figure 2B:
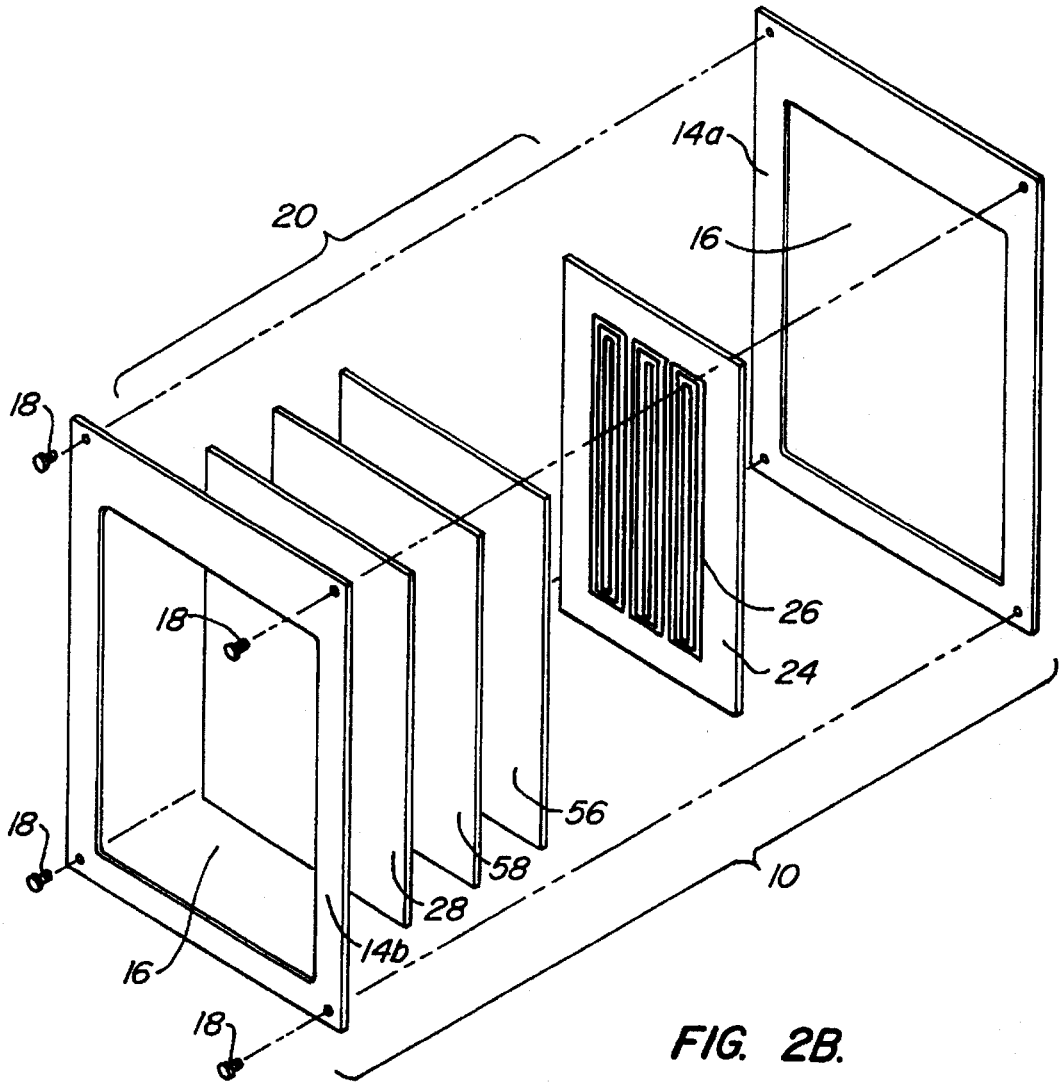
FIG. 2B is an expanded view of a transducer including the diagraming of FIG. 2A and constructed according to the present invention.
Figure 5:
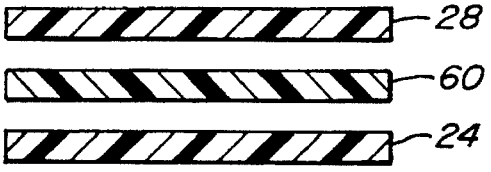
FIG. 5 is a cross-section of a diaphragm constructed according to an alternate embodiment of the present invention.

FIGS. 2A and 5 depict cross sections of a diaphragm 20 with integral magnets constructed according to various embodiments of the present invention. In FIG. 2A, base layer 24 is the bottommost layer. Layer 24 may be constructed of 1 millimeter thickness thin film polyester such as Mylar manufactured by E. I. Dupont de Nemours & Co. of Delaware. Different thickness of material and other thin flexible films may be used. Optionally, paper, tyvek and other paper products may be used for any diaphragm layer including layers 24 and 28. The paper based layers provide a cost savings over the polyimide films. The diaphragm layers may also be either porous or nonporous. Use of waterproof material enables the transducer of the present invention to be used underwater or in marine applications. Varying the thickness of material or the type of material in layer 24 across transducer 20 can be used to alter the frequency response of transducer 20. If transducer 20 is to be used in other than room temperature environments, the base layer material may be selected accordingly to have an appropriate coefficient of thermal expansion for the given operating environment. For example, materials with relatively similar coefficients of thermal expansions may be selected for operation in high temperature environments such as an automobile sunvisor. FIG. 2B shows the diaphragm of FIG. 2A included as part of a transducer 20.

On top of base layer 24 is placed conductor layer 26 which functions as a voice coil. Electrical conductor layer 26 can be produced from light gauge wires. Conductor layer 26 can also be formed of barium ferrite. Conductor layer 26 may be formed by printing or plating the wires to one of the surrounding insulating layers, or by laminating or vapor depositing a metallic coating on one of the insulating layers, and then removing the metal by etching (or a similar process) from those areas where conductors are not desired.

In one embodiment of the present invention, conductive ink is used. The method for creating the printed coil circuit comprises first making a printing screen or stencil containing the pattern of the desired printed circuit. The screen is then used in a screen printer to print multiple copies of the printed circuit on the substrate layer 24 using a heat/pressure lamination similar to that used in electrostatic copiers. Layer 24 substrate may comprise epoxy, polyimide, phenolic or other thermoset laminates in addition to Mylar, as described above. Ideally, the substrate material is compatible with the adhesive in the ink to produce a good strong adhesive bond.

The printed substrate is warmed to evaporate the solvent. When completely dry of the solvent, the circuit is heated to the cure temperature of the adhesive to fully harden the system. Vapor reflow is used to heat the printed circuit rapidly without exceeding the ultimate cure temperature. A multiple heating stage oven may be used to dry, cure and then cool the ink in a controlled manner, minimizing pinholes caused by outgassing, eliminating damage due to severe temperature changes, and achieving complete curing. Post cure heating below this same temperature may also be used to achieve final cure of the ink and optimal adhesion.

Over the cured ink, a thin layer of a non-conductive thermosetting resin can be applied with a screen or stencil printer. The layer applied is patterned to allow vias or passages that remain uncoated with insulating material. After curing of this layer, a second layer of conductive ink may be printed over the insulating layer. The vias or passages then allow electrical interconnection between the upper and lower layers. In this fashion, a two-layer printed circuit is made. The process may then be repeated multiple times to create a printed circuit containing a plurality of layers. Solder mask may be applied over the final conductor layer as in conventional flexible printed circuits.

Other methods for producing one or more electrical conductors for the electrical conductor layer may also be used. For example, in one preferred embodiment of the invention, an ink deposition process known as Lexal developed by the Monsanto Corporation of 800 N. Lindbergh, St. Louis, Mo. is used. Additionally, a metal removal method using an aluminized Mylar such as Colortone from Kurtz Hastings can be employed to form one of the insulating layers, layer 24, for example, and the conductors. A pattern consisting of the negative of the desired conductor pattern is printed on a sheet of paper using either an electrostatic copier or a laser printer. The side of the paper with the pattern is then placed against the aluminized side of the Mylar, and both are run through a heat and pressure fuser similar to one found on an electrostatic copier or laser printer. This process results in the aluminum bonding to the negative pattern because of the pattern's higher temperature. When the paper and the Mylar are separated, the desired conductor pattern remains on the Mylar.

Figure 3:
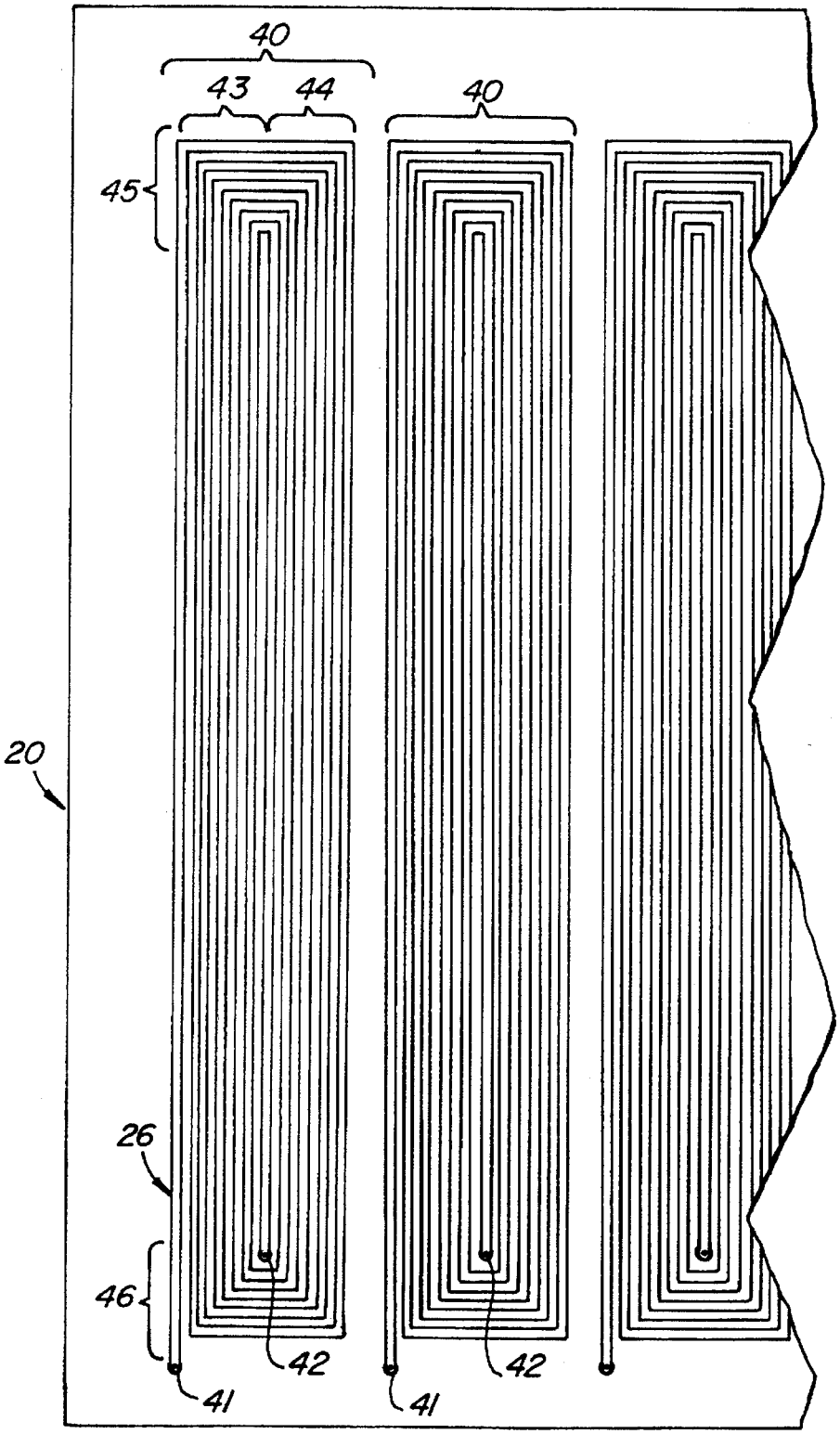
FIG. 3 shows a pattern of conductors on the diaphragm according to an embodiment of the present invention.

FIG. 3 shows the construction of the electrical conductor layer 26 of diaphragm 20 in greater detail. As depicted in FIG. 3, conductors 26 are formed of separate coils 40. When a voltage is applied across terminals 41 and 42, an electrical current flows such that the vertical direction of the current in coil region 43 is opposite the vertical direction of the current flowing in region 44. The length of coils 40 is such that horizontal conductor regions 45 and 46 are outside the principle magnetic flux field produced by the magnetic layer.

The number of vertical conductor lines in the coils depends on the width of the conductor. A smaller conductor line width enables the placement of more conductor lines in the regions and thereby results in an increased impedance for the coils. In one embodiment of the invention, the coil width is approximately equal to the coil spacing. Other widths can be used.

Figure 4:
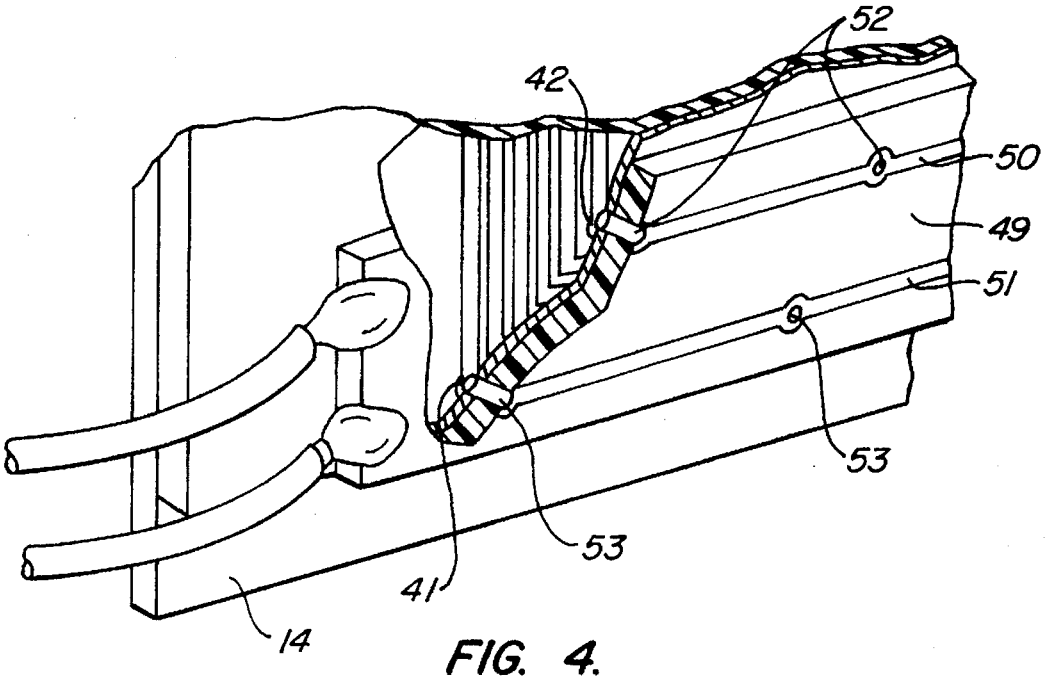
FIG. 4 shows connection of a pattern of conductors to a signal source according to an embodiment of the present invention.

As seen in FIG. 3, each coil has two terminals 41 and 42. FIG. 4 shows one possible way of connecting these coils together and to the signal source. Double-sided printed circuit card 49 contains conductive traces 50 and 51 on one side and plated-through holes 52 and 53 which provide an electrical connection to contact points 41 and 42 on the side of card 49 opposite the conductive traces 50 and 51. Contact point 53 is pressed against coil terminal 47 and contact point 52 is pressed against coil terminal 48 to provide the necessary electrical connections. Depending on the pattern of traces 50 and 51, the coils can be connected in series, parallel, or any other series-parallel configuration. A configuration means, such as switches, can be used to select different series-parallel configurations, allowing the user to alter the impedance of the transducer to match the analog/digital or other signal source.

On top of conductor layer 26 of FIG. 2A is placed an optional second insulating layer 56. Insulating layer 56 is also preferably constructed of a thin plastic film but may also be constructed of paper based materials. Preferably layer 56 is formed of Kapton H also manufactured by E.I. Dupont. Because of the natural attraction of the Mylar and Kapton materials, no adhesive or other means is needed to bond these two layers together. Optionally, the insulating layer may be printed or sprayed.

On top of layer 56 is formed a layer of magnetized material 58. Magnetized layer 58 may be constructed of any common magnetic material. Magnetic material may be sprayed on, poured on, glued on, or otherwise affixed to layer 56. In a preferred embodiment of the invention, layer 58 is comprised of one of nickel or neodymium or composite thereof. The material may be magnetized prior to assembly into diaphragm 20 or optionally magnetized upon completion of the speaker structure. In one embodiment of the present invention, the center to center spacing of the magnetic regions of the material correspond to the center to center spacing of the non magnetic regions. Optionally, the center-to-center spacing of the magnetic region can correspond to the centers of the coil regions 26.

On top of layer 58 is the outer insulating layer 28. Layer 28 is also formed of a thin film paper, plastic, or other coating. For example, layer 28 may be formed of Mylar to naturally bond to underlying insulating layer 56 made of Kapton. Optionally, layers 28 and/or 56 may be printed or sprayed. The materials for layers 24, 56 and 28 preferably are thick enough to prevent damage at the maximum excursion of diaphragm 20. However, if the materials are not flexible or pliable enough, a strong input signal will be necessary to produce the desired diaphragm 20 displacements, resulting in low speaker efficiency.

FIG. 5 shows an alternate embodiment of diaphragm 20. In the embodiment of FIG. 5, the separate magnetic and conductor layers are eliminated and combined into a single layer 60 sandwiched between insulating layers 24 and 28. The single conductive layer may be formed from nickel, neodymium or a composite such as Aluminum nickel alloys or copper nickel alloys. The magnetic residues of layer 60 form a magnetic field that interacts with the field formed by the current flowing through the conductor to define an electromagnetic field. In operation, a voltage is applied to layer 60 in an identical fashion as to voice coil 26 of the previously described embodiments. The interaction of the current and magnetic fields causes displacement of diaphragm 20 to produce sound. An expanded view of a transducer including the diaphragm of FIG. 5 was shown in FIG. 1.

Figure 6A:
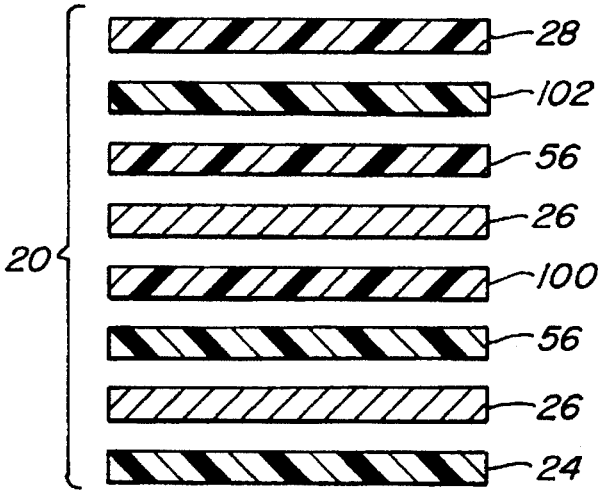
FIG. 6A depicts a diaphragm having multiple conductor layers according to an alternative embodiment of the present invention.
Figure 6B:
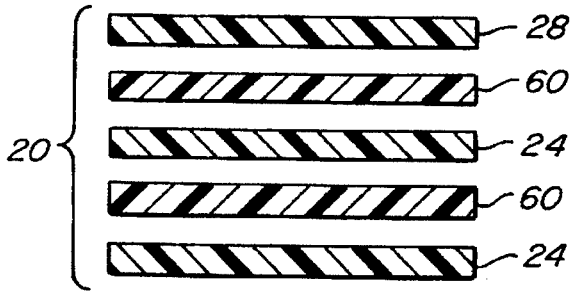
FIG. 6B depicts a diaphragm having multiple magnetized conductor layers according to an alternative embodiment of the present invention.

FIGS. 6A and 6B show how the techniques taught by FIGS. 2 and 5 may be employed to construct transducer diaphragms having sets of opposing magnets and multiple conductor layers within the diaphragm. The diaphragm of FIG. 6A is constructed by repeating the structure of FIG. 2A. In FIG. 6A alternating layers of magnets 100 and 102 have different N-S orientations to form an opposing set of magnets. In FIG. 6B multiple layers of the combined conductive layer and magnetic material layer of FIG. 5 are used. In one embodiment opposite layers of magnets are oriented to have opposing polarity.

Figure 7:
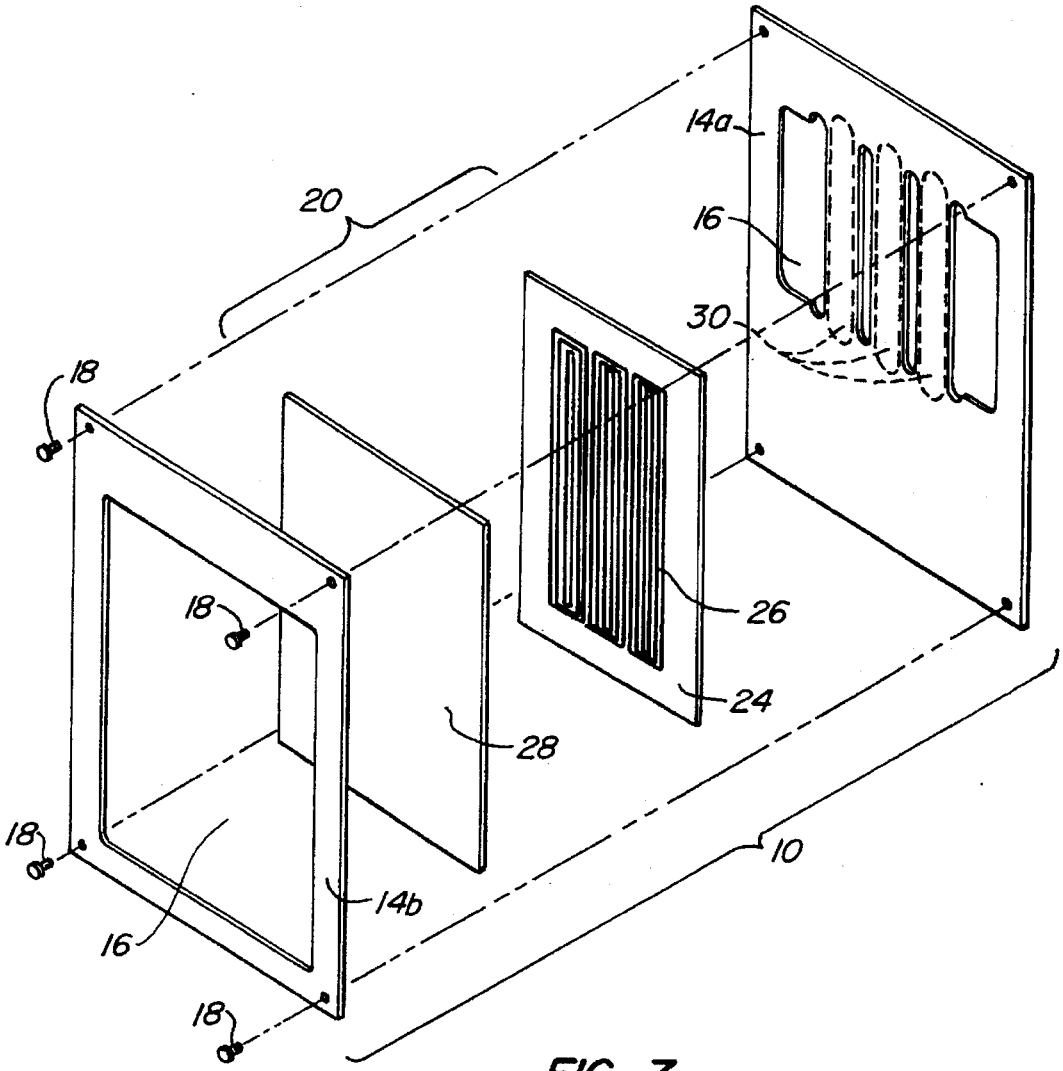
FIG. 7 is an exploded view of a transducer including one set of permanent magnets and constructed according to an embodiment of the present invention.

FIG. 7 shows a transducer having a diaphragm 20 constructed according to an embodiment of the present invention as described above in which a set of permanent magnets are included as part of frame 14*a* . The structure of FIG. 7 still eliminates one set of the two sets of opposing magnets found in prior art transducers. The structure of FIG. 7 therefore permits miniaturization of the frame elements. In the embodiment of FIG. 7, frame 14*a* is shown to include permanent magnets 30. When permanent magnets 30 are included on one-half of frame 14, magnets 30 are arranged so that they have the same polarity (either north or south) toward diaphragm 20. In a preferred embodiment, the center-to-center spacing between magnets 30 is uniform and identical to the center-to-center spacing between an opposing set of magnets such as those contained in diaphragm 20 (not shown in FIG. 7). Magnets 30 are offset from the opposing magnets in the diaphragm so that the centerline of each magnet 30 corresponds to the center of the space between two opposing magnets. This structure results in a linear pattern for the lines of flux between the two sets of magnets. Other spacings may be used.

Magnets 30 may comprise fixed permanent magnets that are assembled into frame 14*a* prior to joining of the frame elements. Magnets 30 may be bonded to backings made of non-ferrous material, such as fiberglass or plastic using epoxy resin or any other suitable means of bonding or attachment. Preferably the backing or other attachment means is made from a non-ferrous material so as to minimize any adverse effect on the linearity of the magnetic field. Non-ferrous material can also be used for the remaining structure of frame 14 if desired to minimize unwanted coupling of the magnetic fields of two adjacent magnets. The non-ferrous material used for the support can be any non-ferrous material which has sufficient structural integrity to support magnets 30. For example, Fiberglass and plastic. Optionally ferrous materials may be used.

Figure 8:
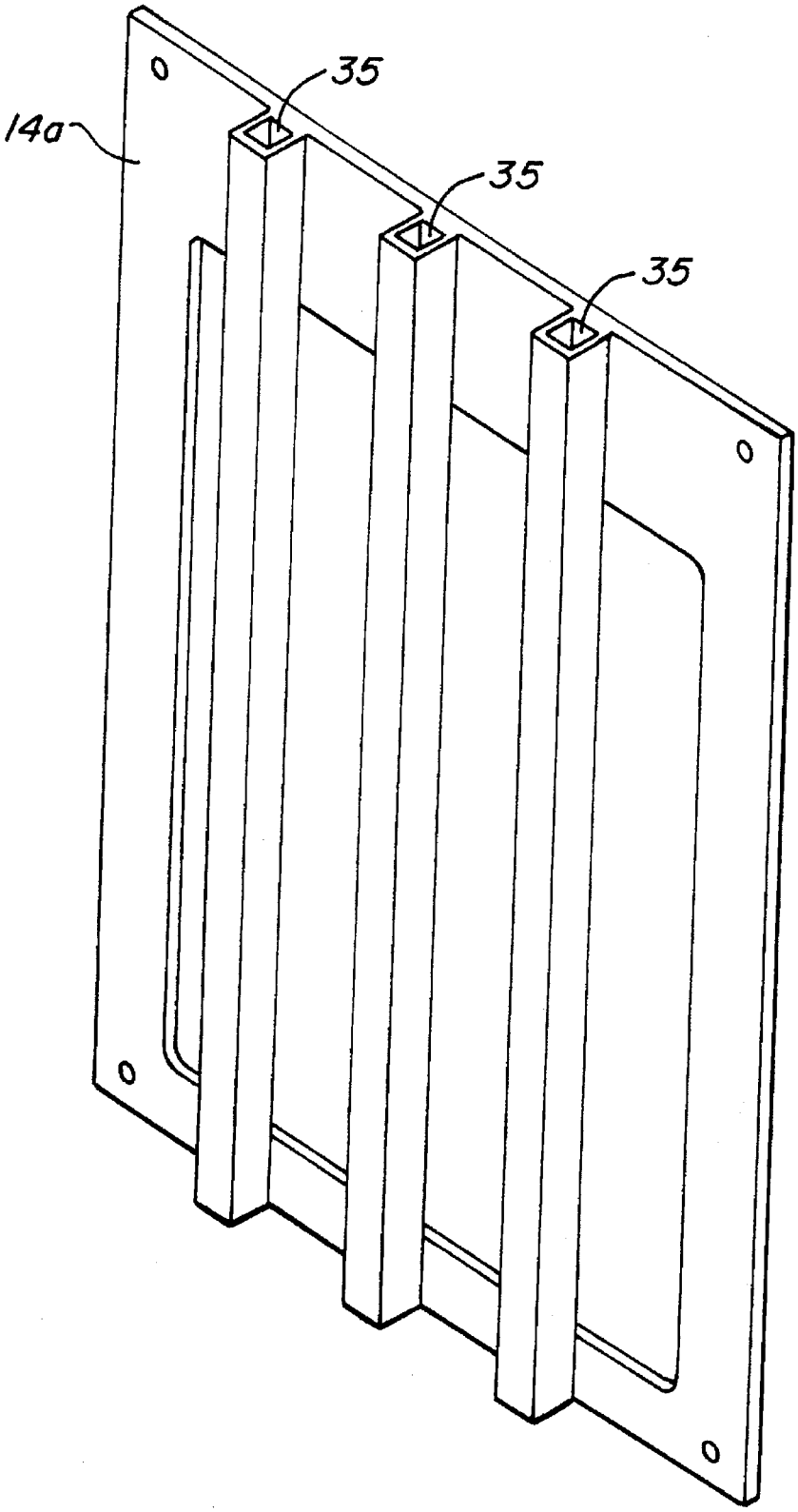
FIG. 8 is a view of a plastic enclosure for encasing magnetic powder within a transducer frame according to an embodiment of the present invention.

Other forms of support for the magnets can be used. For example, as depicted in FIG. 8, the magnetic material can be enclosed in an enclosure 35 which is a rectangular tube plastic extrusion. Other enclosures or partial enclosures of non-ferrous material can be used to enclose or partially enclose the magnetic material. The enclosure, or partial enclosure, can be color-coded to indicate the frequency range of the transducer or for other informational purposes. Optionally, magnets 30 may be formed integrally with frame 14*a*, by pouring, for example, unmagnetized Alnico (aluminum, nickel and cobalt) alloy material into the extruded rectangular tube support or frame 14*a* may be formed of a matrix of metal powder. Optionally, the magnetic material may be spread or sprayed onto the frame.

Figure 9:
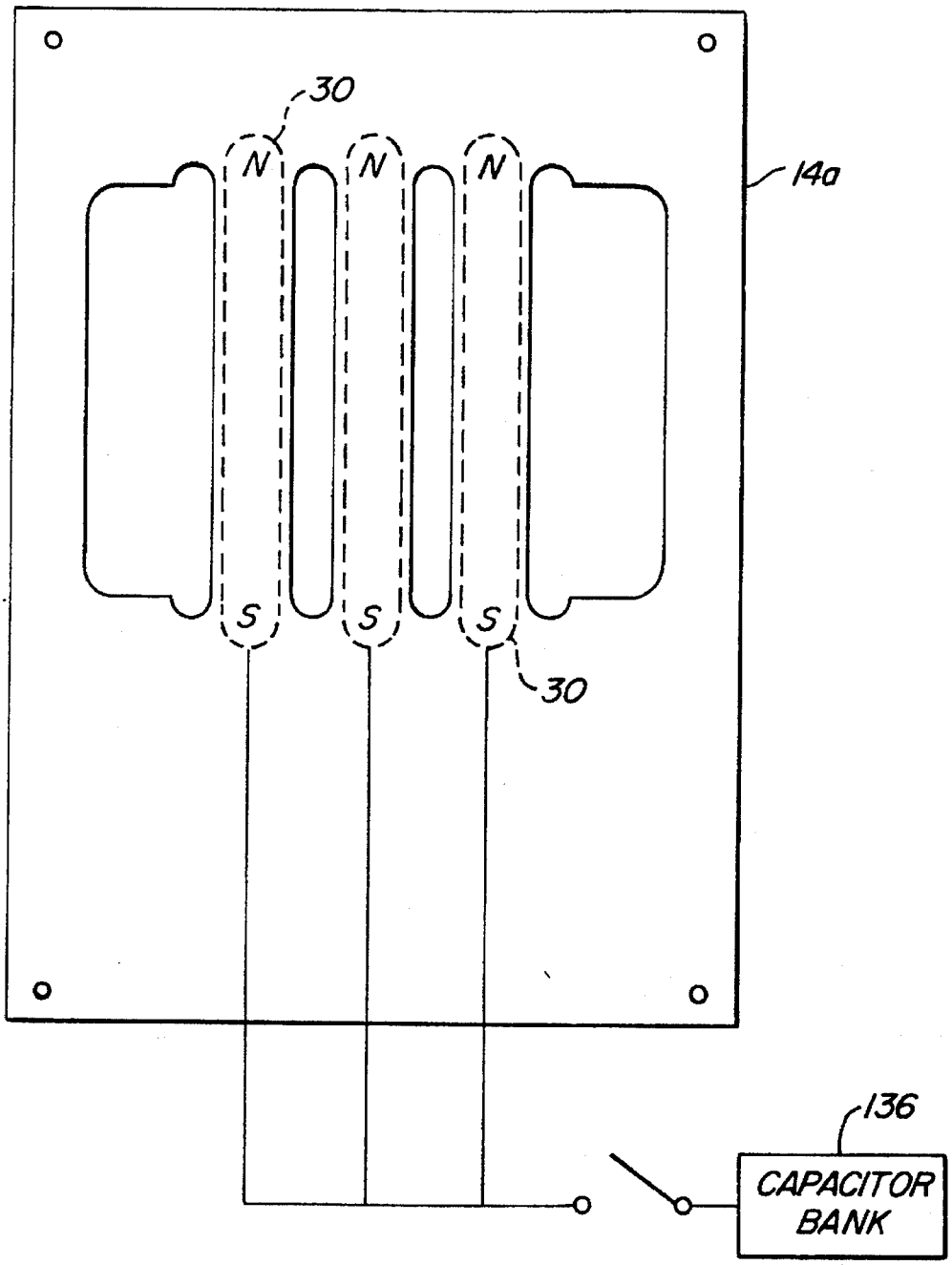
FIG. 9 is a view of a magnetized frame charged by discharge of a capacitor bank.

After all parts of the magnetic assembly have been assembled, the entire assembly can be placed within an electromagnet or solenoid powered by the discharge of a capacitor bank. Activation of the solenoid 136 produces an electromagnetic pulse that magnetizes the magnetic material within the frame. See FIG. 9.

Figure 10A:
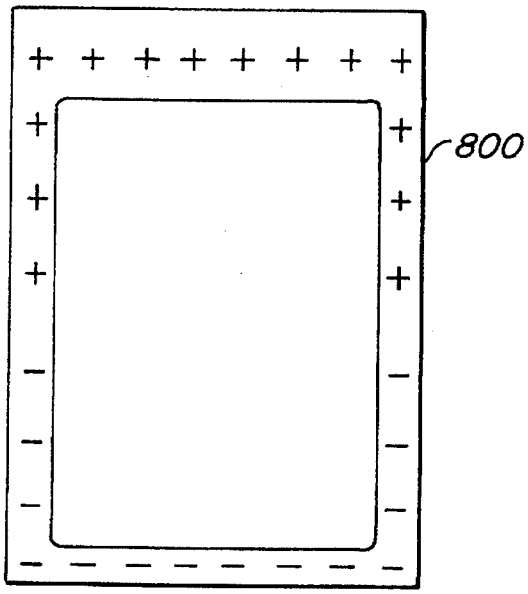
FIG. 10A is a drawing showing use of the frame as an electromagnetic field.

FIG. 10A shows another embodiment of a transducer constructed according to the present invention in which the magnetic material can be contained solely integral to the supporting frame structure itself. In FIG. 10A, frame 800 is formed of a magnetic material matrix as described previously. The magnetic material on one half of the frame is charged to a first polarity and the magnetic material on the second half of the frame is charged to a second polarity. Charging of the frame may be done by use of a solenoid and a capacitor bank as previously described. The resulting frame has a first magnetic field created by one half of the frame and the opposing magnetic field created by the second half of the frame. In FIG. 10A these two halves are shown as the top and bottom. Any bisection or other division of the frame is possible. For example, the frame may be bisected into two vertical halves or bisected diagonally. Optionally, only the corner regions of the frames may be magnetized.

Figure 10B:
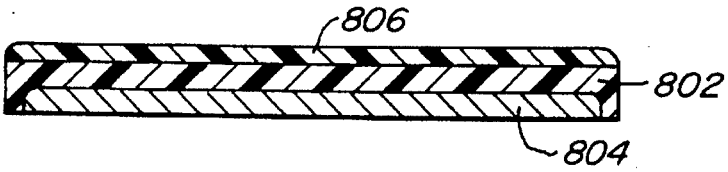
FIG. 10B is a side end view of a frame with integral magnet constructed according to an embodiment of the present invention.

FIG. 10B shows an end view of yet another construction of the magnetic influence integral with the supporting elements. The structure of FIG. 10B includes a styrofoam, plastic or other material block 802. Also contained within and/or secured by block 802 is permanent magnet 804. Over block 802 is laid the diaphragm 806 which may be formed of Kapton Mylar or other materials as previously described. Voice coils, not visible in FIG. 10B, are formed on the diaphragm also as previously described. Optionally, the voice coils may be applied directly on block 802. In this construction, block 802 becomes both the diaphragm and magnetic influencer as a single integrated component.

Forming the magnetic field integral with the frame further reduces the bulk, complexity and expense of transducer frames which normally were required to support large permanent magnets. Speakers, antennae and microphones incorporating this technology can therefore be miniaturized more readily and will be more efficient for a given weight. Forming the magnets integral with the frame also reduces the likelihood that the diaphragm will move out of optimum position with the field of electromotive force during normal excursions. The device is thus more nearly a true push-pull, bi-polar radiating device. Transducer response is thereby improved over conventional devices.

Figure 10C:
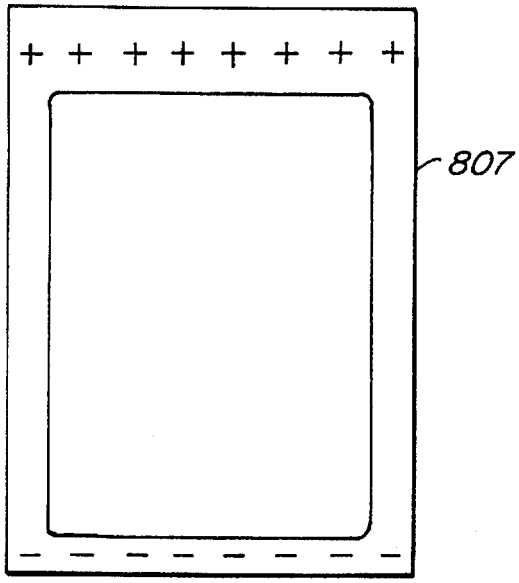
FIG. 10C is a drawing showing use of the frame as an electrostatic field.

Although the aforementioned described embodiments use magnets to generate an electromagnetic field, an electrostatic field, such as a field found between two charged plates can also be used. In one embodiment of the present invention as shown in FIG. 10C, the transducer is constructed such that, for example, the top half of the frame 807 is charged to act as a positive capacitor plate and the bottom half of the frame 807 functions as a negative capacitor plate. The diaphragm functions as an insulator between the two plates. Because there is no longer a gap as found between the stator and diaphragm of prior art electrostatic designs dielectric breakdown and arcing of the speaker is eliminated. The speaker of the present invention thus has a longer useful life than prior art designs.

Figure 10D:
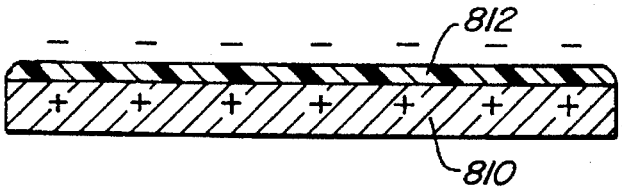
FIG. 10D shows a side view of an electrostatic speaker including styrofoam block constructed according to an embodiment of the present invention.

FIG. 10D shows construction of an electrostatic speaker using a styrofoam block. FIG. 10D shows a side view of an electrostatic transducer in which a block 810 of styrofoam, plastic or other material is charged to a first polarity. Overlying block 810 are voice coils 812 charged to a second polarity. The voice coils may be located on a layer of insulating material (not shown). The diaphragm on which coils 812 are printed functions as the insulating layer. Optionally, the coils 812 may be directly applied to block 810. In this case, the frame, or block 810 becomes both the diaphragm and electromotive influence as a single integrated component. As current passes through coils 812, the diaphragm interacts with the electrostatic field producing sound. The structure of FIG. 10D also has the advantage of eliminating the arcing problems found in conventional electrostatic speakers.

Figure 11:
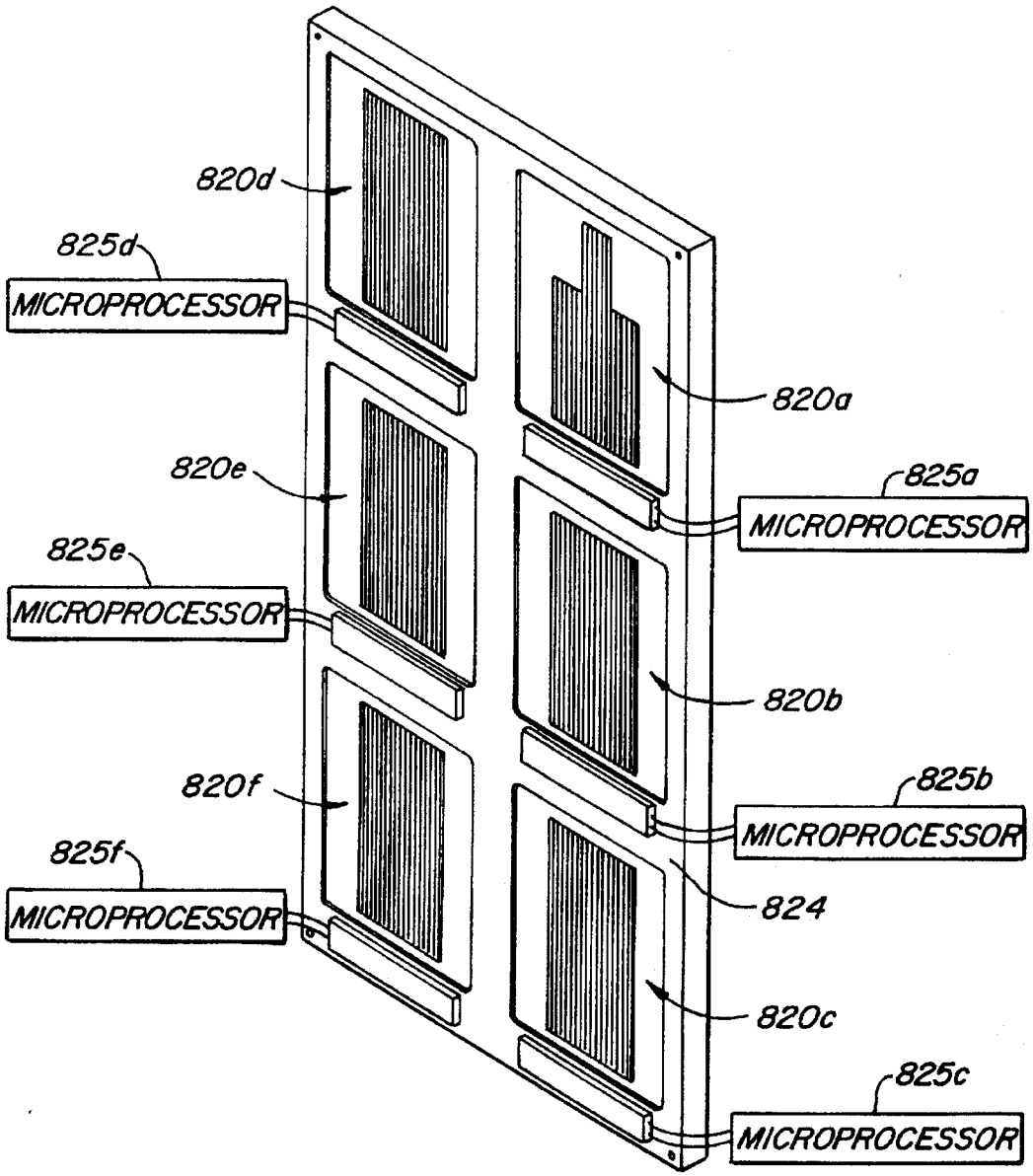
FIG. 11 is a drawing of a speaker system having multiple transducers according to an alternative embodiment of the present invention.

FIGS. 11–18B show possible modifications that may be made of any of the previously disclosed embodiments. FIG. 11 illustrates how two or more planar electromagnetic transducers can be combined to form a system capable of handling higher power, producing more acoustic energy, or providing better frequency response. Each transducer 820 is attached to a frame 824. Transducers 820 can be constructed according to any one of or according to a combination of any of the above-mentioned techniques. The individual transducers of the system can be connected either as a series electrical circuit, giving a system impedance equal to the sum of the impedances of the transducers; a parallel circuit, giving a system impedance equal to the impedance of an individual transducer divided by the number of transducers; or a series-parallel circuit, giving an impedance somewhere between these two values. A configuration means, such as switches, can be used to select different series-parallel configurations, allowing the user to alter the impedance of the transducer to match the signal source.

FIG. 11 also shows how the transducer of the present invention can be under direct user control and/or be individually controlled utilizing software or microprocessor 825*a–f*. For example, the transducer coupled to processor 825*a* may be controlled to function as an antenna. The antenna receives a broadcast and radio signal to be reproduced on remaining transducers 820*b–f* as sound or the transducer coupled to processor 825*a* may be receiving or broadcast command or communication signals used to control operating of the device to which the receiving transducer is coupled. The different coil regions of transducer 820*a* may be tuned and independently operated to different frequencies. Transducers 820*b–f* may be controlled to operate in different frequency ranges or to play different channels or source signals as directed by the associated control device. A given transducer 820 may also be controlled to function as a microphone. Thus, the transducers of the present invention may be included as an array which can receive and reproduce any type of signal as an integrated unit. This feature makes the transducer of the present invention particularly suitable for use as wireless communications and in robotics applications.

In addition to being individually and actively controlled, the individual transducers 820 of FIG. 11 can be configured with different frequency responses by using different materials for the diaphragm or by varying the distance between the diaphragm elements voice coils and the magnets. The distance to the magnets may be varied by altering the thickness of the insulating layer between the conductor layer and the magnets. Alternatively, if the frame also contains permanent magnets, the distance from the frame to the diaphragm may be varied. A frequency selective network, such as a cross-over network commonly employed in conventional speaker systems, can be used to route the appropriate frequency ranges from the input signal to the proper transducers. The techniques for connecting multiple transducers using a frequency selective network is well known to persons with ordinary skills in the art. To aid in the identification of transducers with particular frequency ranges, their diaphragms can be constructed from color-coded material and the magnet assemblies can be similarly color-coded.

Figure 12A:
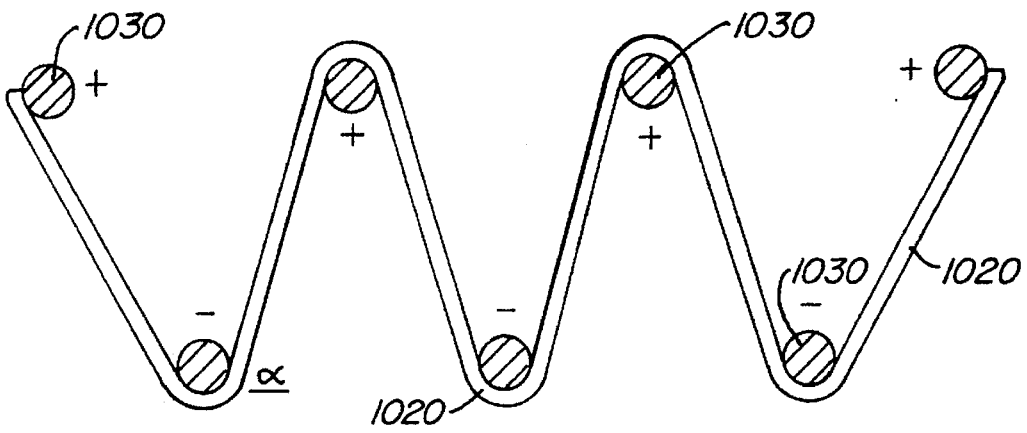
FIG. 12A shows an end view of yet another embodiment of a transducer in which a diaphragm is woven through a series of magnets.
Figure 12B:
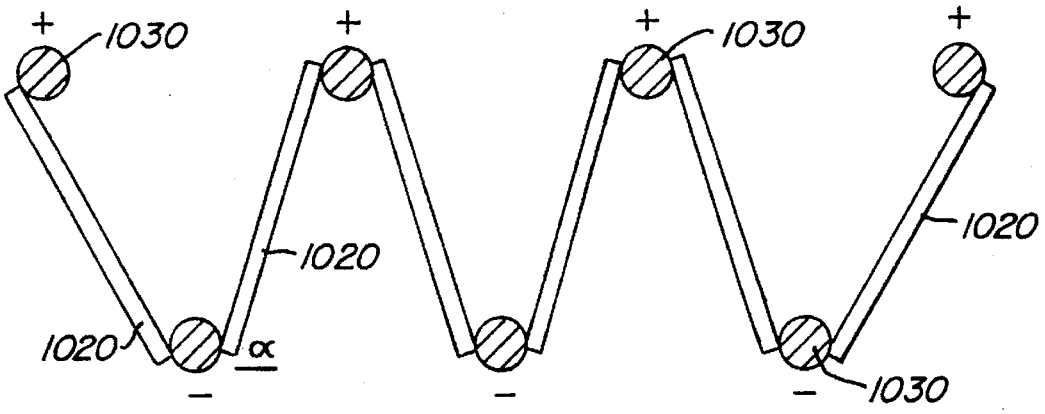
FIG. 12B shows an end view of a transducer comprising a series of individual diaphragms placed between a series of magnetic columns according to an embodiment of the present invention.

FIGS. 12A and 12B show end views of yet another embodiment of a transducer. In the embodiment of FIG. 12A, diaphragm 1020 wraps around a magnetic pole of material 1030. Diaphragm 1020 may comprise a conductor layer on a base layer, so as not to be in contact with magnets, a conductor layer sandwiched between two insulating layers, or may include a magnetized conductor layer or a magnetized layer, as previously described herein. Multiple diaphragm layers may also be used.

Optionally, a series of individual diaphragms 1020*a*–1020*f* may be secured to each pole magnet 1030 as shown in FIG. 12B. The individual diaphragms 1020*a*–1020*f* may be constructed to have different frequency response ranges according to the techniques previously described. FIG. 12B is shown with a single diaphragm layer. However, any one or more of the diaphragms 1020*a*–1020*f* may be constructed as a multiple layer diaphragm if so desired.

In one embodiment of the invention, the pole to pole spacing is approximately 2 inches. Other dimensions are possible to obtain variations in efficiency, frequency response and to satisfy overall size requirements. The angle $\alpha$ between the pole and the diaphragm is chosen as desired. Smaller angles permit a larger surface area of vibrating element to be placed in a given volume.

Figure 13:
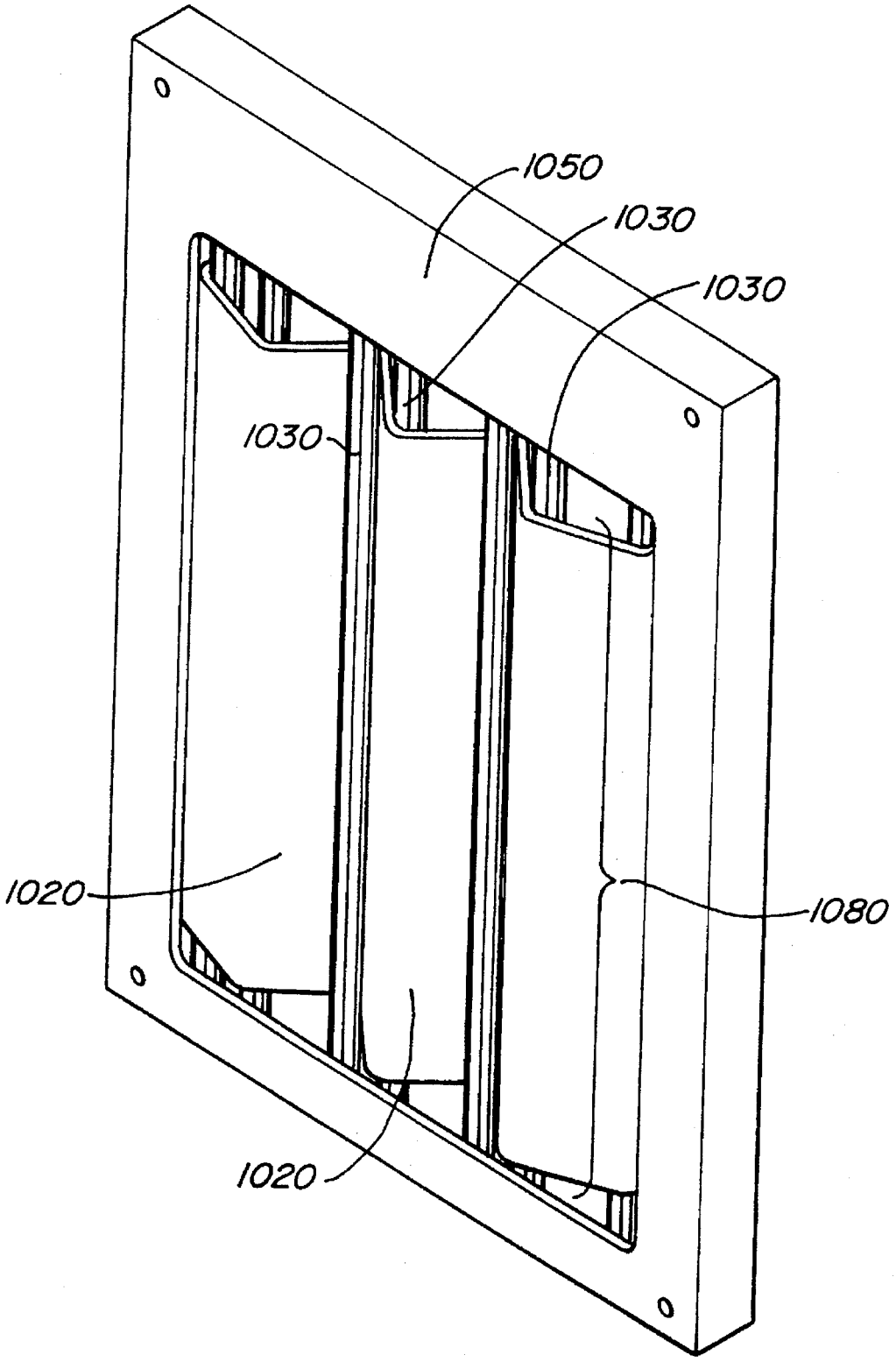
FIG. 13 is a perspective view of a transducer constructed according to the teachings of FIGS. 12A and 12B.

FIG. 13 shows a perspective view of a transducer constructed according to the teachings of FIGS. 12A. FIG. 13 shows the magnet 1030 and diaphragm 1020 structure supported by a frame 1050. Frame 1050 may be constructed of simple nonferrous, non magnetic materials of sufficient strength to support the magnet and diaphragm assembly. Optionally, frame 1050 and magnets 1030 are a single unitary structure. Magnets 1030 may be formed by pouring magnetized powder, as previously described, into frame 1050 at those locations corresponding to magnets 1030. Alternatively, frame 1050 can be constructed of a metal powder matrix and then charged to the desired polarity as was also previously described. Frame 1050 can also be devoid of magnetic properties. In the case where frame 1050 is constructed without magnets, the electromotive force can be provided by using the magnetized diaphragm constructions as taught in FIGS. 2A, 5 and 6A–6B.

In the embodiment of FIG. 13, diaphragm 1020 is shown anchored at only two edges to tension the diaphragm. Optionally, diaphragm 1020 may be anchored to frame 1050 along all four of its edges to form a planar type speaker. The transducer FIG. 13 includes the advantages of the previously described embodiments. In addition, the transducer of FIG. 13 also permits the diaphragm elements to be positioned to radiate sound in a specific direction. For example, region 1080 may be focused to radiate sound in a desired direction to take advantage of the unique frequency response characteristics of a particular setting and/or to cancel out various frequencies. In this manner, region 1080 has many of the directional advantages of a cone speaker.

Figure 14A:
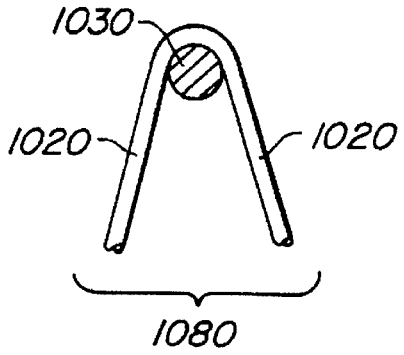
FIG. 14A is an expanded view of a region of the transducer of FIG. 13 constructed as a cone.

Furthermore, when frame 1050 includes magnets 1030, transducer 1010 may be thought of as a series of cones each having a magnet driver 1030 and an associated "cone" or diaphragm element such as region 1080. However, the cone like structure of the present invention operates with the advantages of a push pull device unlike the cones of the prior art. FIG. 14A shows an expanded view of the example cone region of FIG. 13.

Figure 14B:
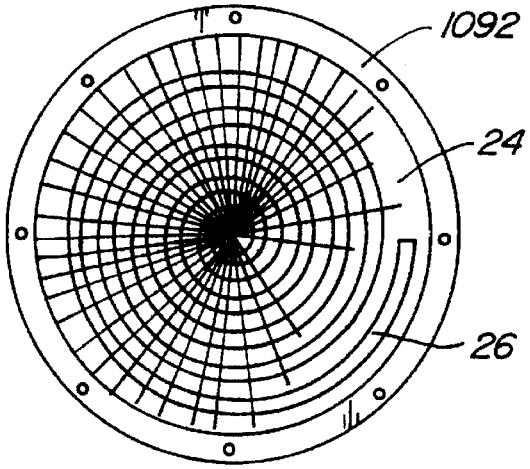
FIG. 14B is a view of a diaphragm of the present invention formed as a cone according to an alternate embodiment of the present invention.
Figure 14C:
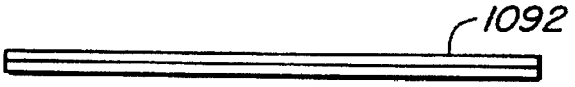
FIG. 14C is a side view of the diaphragm of FIG. 14B.
Figure 14D:
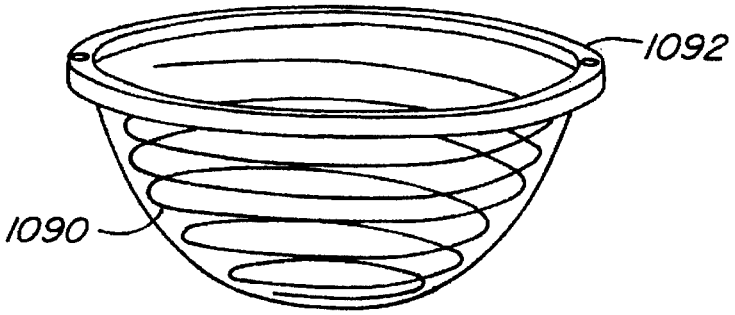
FIG. 14D is a side view of a transducer formed as a convex cone according to an embodiment of the present invention.

Optionally, the diaphragms of FIGS. 2A, 5, 6A and 6B can be shaped to function as a cone speaker. The speaker of FIGS. 14B and 14C is in the form a planar radiator cone. Traditional cone speakers function as electro-motor piston type devices. As they are driven to maximum points of deflection the coil elements of the piston drive are pushed farthest away from the magnet. When they snap back to return to the origin point unwanted distortion is created usually in the form of voltages which is sent back to the signal processor or amp. The construction of FIG. 14B omits the separate magnetic driver of FIG. 14A. Thus, the cone of the embodiment of the present invention is a true push-pull device having the directional characteristics but not the feedback problems of traditional cone elements. FIG. 14C is a side view of the cone of FIG. 14B. Optionally, the cone may be formed in a convex shape as in the traditional cone speaker. FIG. 14D shows a side view of a convex cone transducer element according to an embodiment of the present invention. The electromotive force is provided by the magnetized layers formed integral with diaphragm 1090 as previously described. Optionally frame 1092 may be constructed of magnetized material to provide the electromotive force.

Figure 15A:
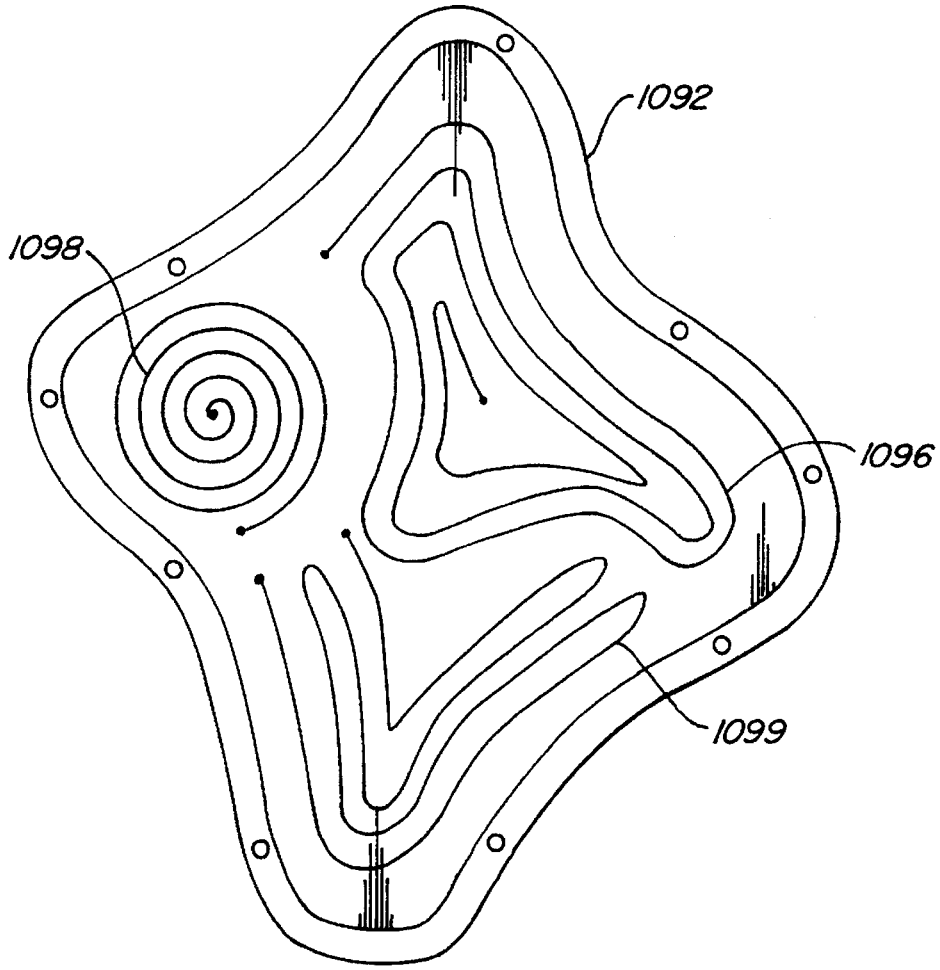
FIG. 15A is a top view of a transducer of irregular shape constructed according to an embodiment of the present invention.
Figure 15B:
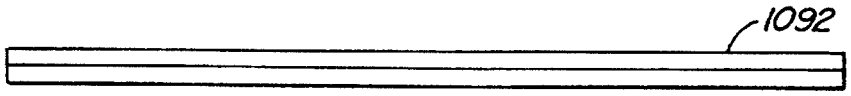
FIG. 15B is a side view of the transducer of FIG. 15A when constructed as a planar transducer.
Figure 15C:
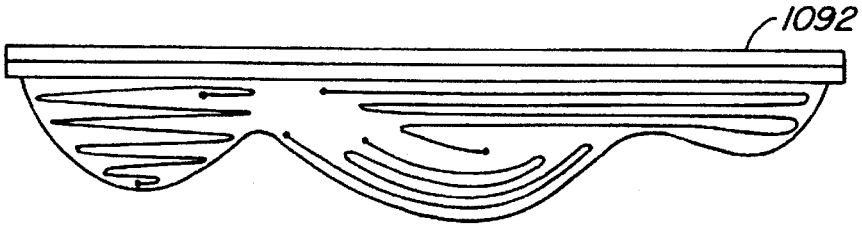
FIG. 15C is a side view of the transducer of FIG. 15A constructed to have complex shapes according to an embodiment of the present invention.

The ability of the present invention to be turned into various complex shapes not only enables the transducer element to be placed in locations of unconventional geometry and in locations of where prior art transducers and speakers simply could not be located but, also enables the transducer to be shaped to emphasize or cancel frequencies as desired. FIGS. 15A–15C illustrates the advantages of the free-formed transducer of the present invention. FIG. 15A shows a transducer constructed of irregular shape and retained in frame 1092. The irregular shape of FIG. 15A may be, for example, to allow the transducer to fit in a confined space or in locations of non-standard geometry. The transducer of FIG. 15A may also contain different coil regions 1096, 1097, and 1098. Regions 1096, 1097 and 1098 may be, for example, regions of different frequency response.

FIG. 15B shows a side view of FIG. 15A when the transducer is constructed as a planar device. Optionally, the transducer of FIG. 15A may be constructed to have various convex and concave regions as shown in FIG. 15C. These convex and concave regions permit the transducer to emphasize certain frequencies, cancel certain frequencies and/or direct the sound in a desired direction. This feature is useful in compensating for the particular acoustics of a given setting or when the transducer is used for specific applications where such a tailored response is desirable. The transducer of FIG. 15C can be vacuum formed, molded or extruded into the desired convex and concave regions.

Figure 16:
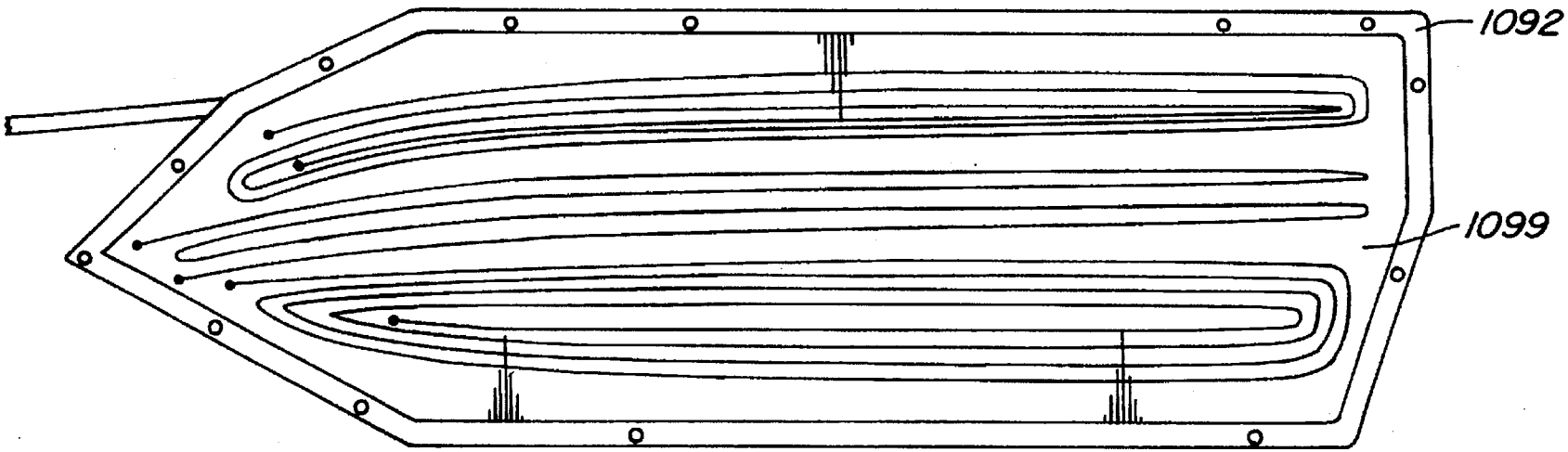
FIG. 16 shows a transducer formed integral with an automobile sunvisor according to an embodiment of the present invention.
Figure 17A:
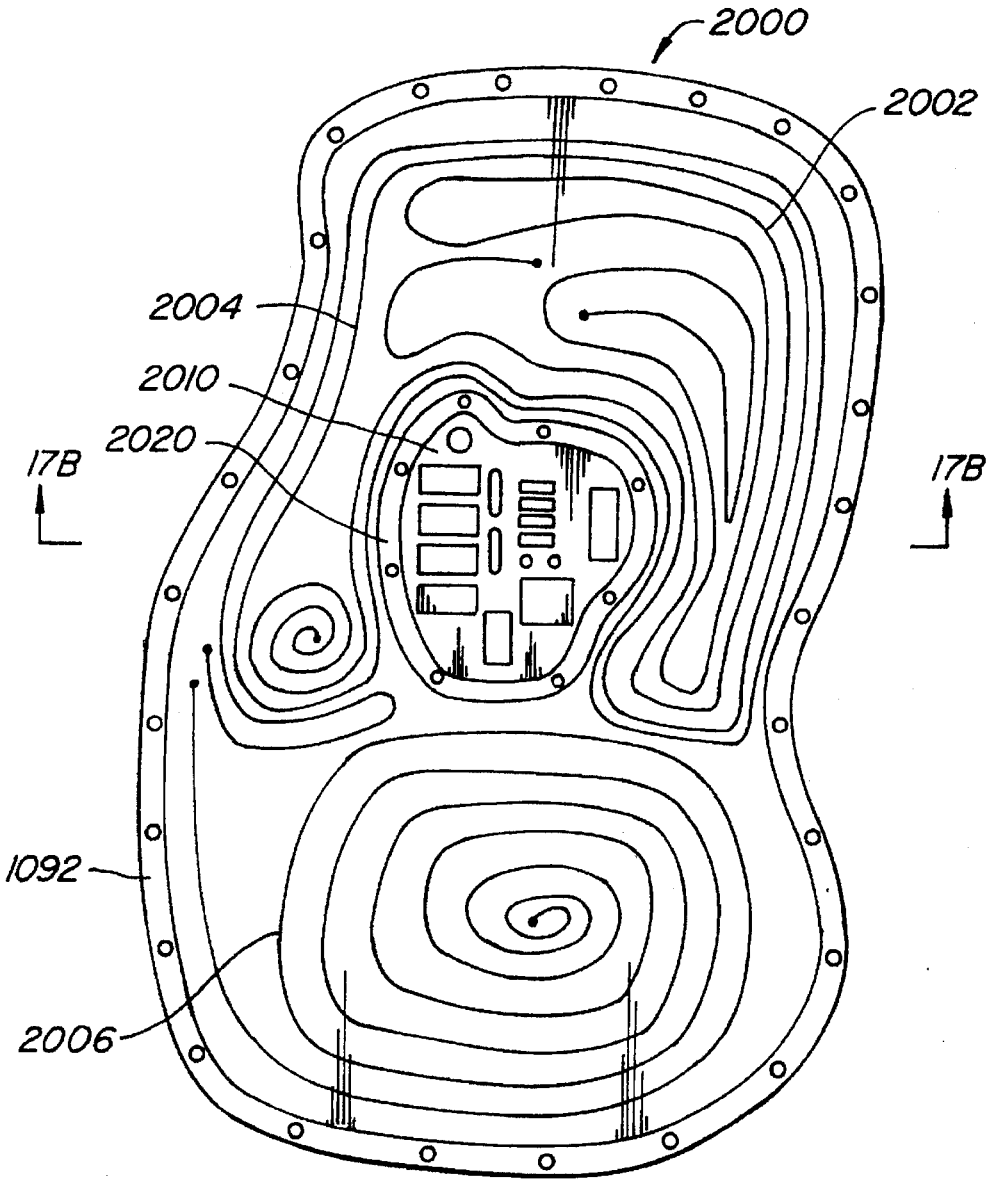
FIG. 17A shows a variable geometry transducer formed integral with audio components according to an embodiment of the present invention.
Figure 17B:
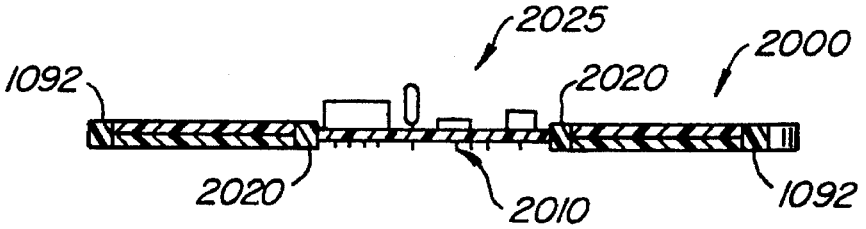
FIG. 17B shows a side cross sectional view of the transducer of FIG. 17A.

FIGS. 16 and 17A and 17B further illustrate the advantages of the variable geometry transducer of the present invention. FIG. 16 shows a transducer 1099 in the shape of an automobile sunvisor. The transducer of variable geometry of the present invention may thus be located unobtrusively and integral with common household, automobile and other consumer components. For example, the transducer of the present invention may be formed integrally with an automobile or armchair headrest or as part of a mannequin or robot, or air line tray table.

FIGS. 17A and 17B illustrate how the variable geometry transducer of the present invention may be formed integral with and to accommodate the limited cabinet spaces of today's modern electronic components. The variable geometry transducer 2000 enables the transducer to fit any custom shape and also permits customization of the output characteristics as has been described above. Transducer 2000 may also contain multiple coils 2002, 2004, and 2006 in various layouts to provide tweeter, woofer and midrange capabilities as also described above. For ease of placement installation, the coils and/or transducer regions may be color coded to identify the various speaker regions.

Integral with transducer 2000 of FIG. 17A, is a cut out area 2010 surrounded by a secondary frame 2020. Cut out area 2010 permits transducer 2000 to be located around unusual shapes or to place electronic circuitry, such as an amplifier in or around the transducer itself. FIG. 17B shows a side cross sectional view of the transducer of FIG. 17A. In FIG. 17B, electronic component of 2025 is seen formed integral with the transducer. Component 2025 may be, for example, an audio amplifier, a wireless communications device, microprocessor, or digital circuit.

Figure 18A:
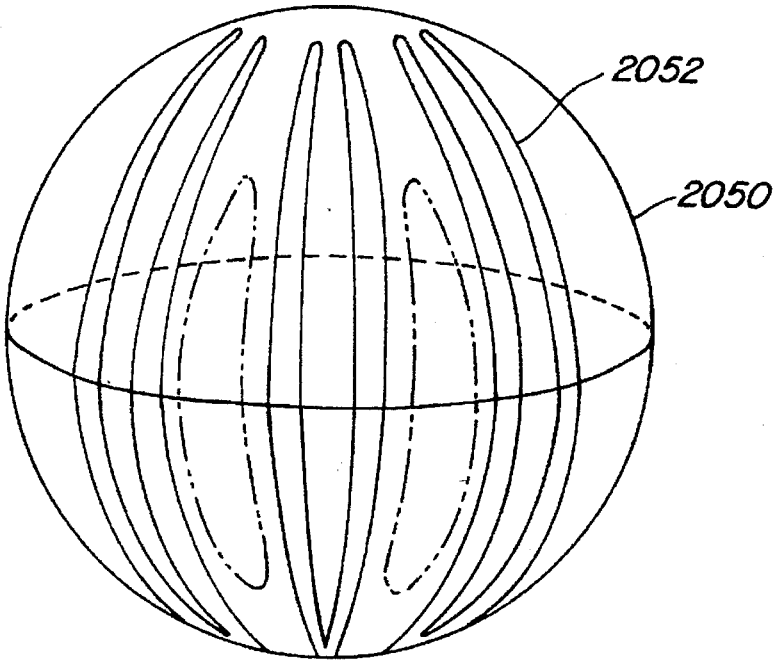
FIG. 18A shows a transducer constructed as a sphere according to an embodiment of the present invention.
Figure 18B:
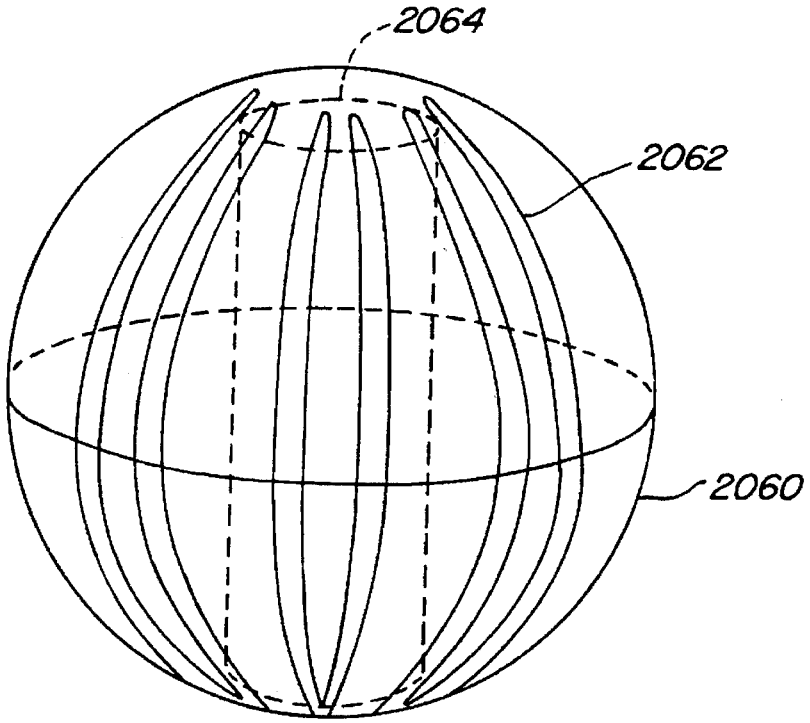
FIG. 18B shows a spherical transducer constructed as a true point source device according to an embodiment of the present invention.

FIGS. 18A and 18B show how the variable geometry transducer of the present invention enables construction of an ideal bipolar radiator in which sound emanates in all directions and hence is a true point source of sound. In the embodiment of FIG. 18A a spherical vibrating element 2050 formed of charged styrofoam, plastic or other material contains voice coils 2052 thereon. Vibrating element 2050 and voice coils may be constructed according to any of the techniques previously described herein. The sphere may be either hollow or solid and may optionally include sound or vent holes. In the embodiment of FIG. 18A, the spherical device acts as an electrostatic speaker. Because of the spherical shape, the device of FIG. 18A radiates sound equally in all directions forming a theoretically ideal bidirectional radiator. The sound produced on the side of the sphere can be vented out, cancelled or absorbed as desired.

FIG. 18B shows an alternate construction of a bipolar radiator as a true point source device. The device of FIG. 18B also includes a spherical or spheroid vibrating element 2060 formed of plastic, styrofoam, or other material as described herein. The vibrating element contains voice coils 2062 thereon. The sphere may also have sound holes if desired. Located on an axis of the sphere is a permanent magnet 2064. Permanent magnet 2064 is shown as a cylinder, but may optionally have other shapes. For example, magnet 2064 may be a spheroid or other shape suspended or within the center of the outer sphere. In operation current passing through the voice coils interacts with the magnetic field of magnet 2064 causing movement of the vibrating element 2060 to produce sound which emanates in all directions. As in the embodiment of FIG. 18A, the sound on the inside of the sphere may be vented, cancelled or absorbed as desired.

FIGS. 11–18 thus illustrate how the variable geometry transducers of the present invention enable formation of multiple function arrays of transducers. These figures also illustrate how the transducers of the present invention can be shaped as curvilinear surfaces and/or complex solids. The variable geometry and ability for multipurpose transduction of the present invention enables its use in a variety of applications and as an integral component of existing devices of complex shape, i.e., mannequins and robots.

Figure 19:
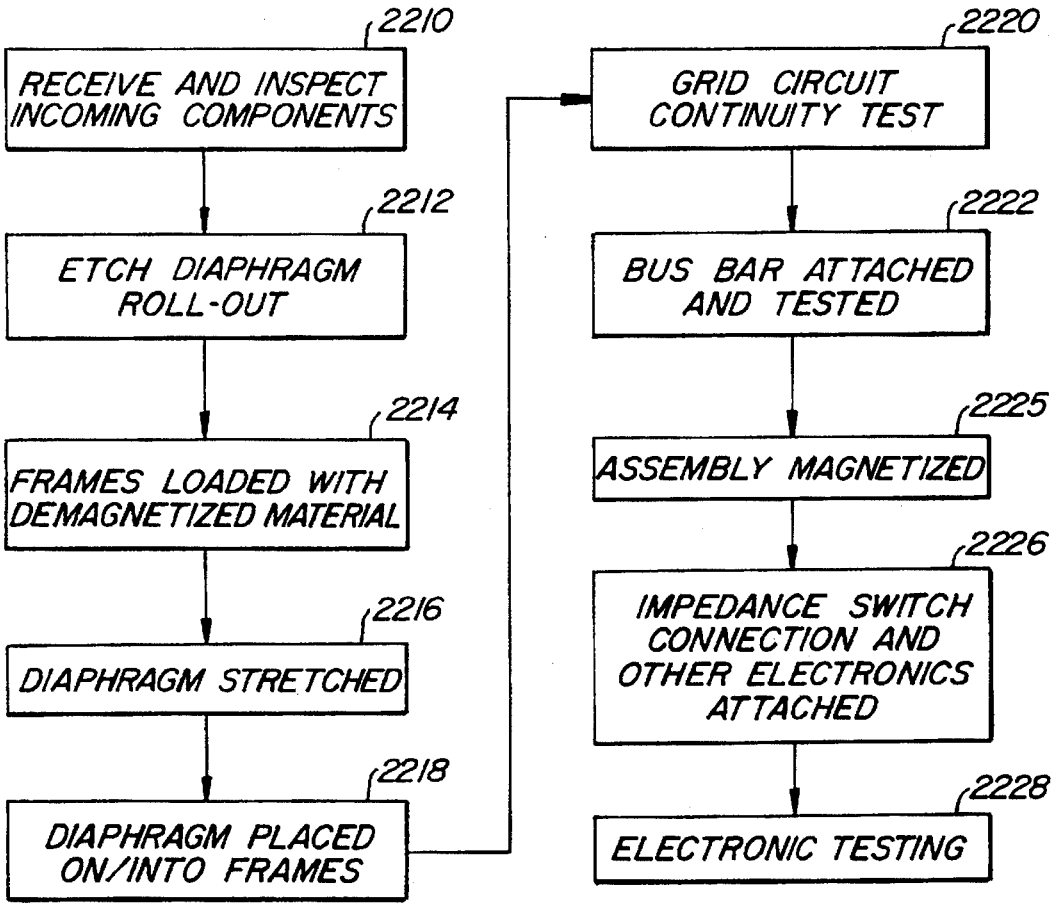
FIG. 19 is a flow chart of a method useful for constructing any of the aforementioned transducers.

FIG. 19 is a flow chart of a method useful for constructing a transducer according to the teachings of the present invention. In the process flow of FIG. 19, incoming materials are first inspected in step 2210. If the coils are not applied directly to the frame, and a separate diaphragm material is to be used, the diaphragm is constructed in step 2212 including etching of the voice coils onto the associated layers. Otherwise, the coils may be directly formed on the frame. If the frame material is to include magnets or form part of the transducer electromagnetic or electrostatic field, the frame elements are for example loaded with the scintered metal powder or demagnetized material in step 2214. In steps 2216 and 2218, the diaphragm is stretched to the desired tension and placed within or on the frame structure. Continuity testing of the conductor layers is conducted in step 2220 prior to attaching a signal bus bar in step if desired 2222. The frame assembly, and or magnets are then magnetized according to the techniques previously described in step 2225. Impedance switch componentry or control circuitry is then attached in step 2226 prior to audio and electronic testing in step 2228. The completed device can then be warehoused and/or shipped.

It is to be understood that the above described arrangements are merely illustrative of numerous and varied other arrangements which may constitute applications of the principles of the invention. Such other may be readily devised by those skilled in the art without departing from the spirit or scope of this invention.

What is claimed is:

1. An electroacoustic transducer comprising:

a flexible diaphragm having:

(a) a first layer of electrically insulating material; and (b) an electrical conductor layer, attached to said first layer of electrically insulating material, which incorporates both a conductor pattern and permanently magnetized material; and a frame for supporting said diaphragm.

2. The transducer of claim 1 wherein said frame has a first portion charged to a first magnetic polarity.

3. The transducer of claim 1 wherein said frame is non-ferrous.

4. The transducer of claim 1 wherein said diaphragm further includes a plurality of said insulating layer and a plurality of said electrical conductor layer to form a multilayered diaphragm.

5. The transducer of claim 1 further comprising a control device coupled to said diaphragm for controlling operation of the transducer.

6. The transducer of claim 1 adapted to act as an audio loudspeaker.

7. The transducer of claim 1 adapted to act as a microphone.

8. The transducer of claim 1 wherein said conductor pattern is in the form of a coil.

9. The transducer of claim 1 wherein said conductor pattern includes a plurality of coils.

10. The transducer of claim 9 adapted to simultaneously transduce as both an audio loudspeaker and an antenna.

11. The transducer of claim 10 adapted for use in an automobile sunvisor.

12. The transducer of claim 1 adapted for use in an automobile sunvisor.

13. An electroacoustic transducer comprising:

a plurality of flexible diaphragms disposed in an array, each of said diaphragms of unique frequency response and having:

(a) a first layer of electrically insulating material; and, (b) an electrical conductor layer, attached to said first layer of electrically insulating material, which incorporates both a conductor pattern and permanently magnetized material; and, a frame for supporting said plurality of flexible diaphragms.

14. The transducer of claim 13 wherein each of said plurality of diaphragms is connected to a control device.

15. An electroacoustic transducer comprising:

a flexible diaphragm having:

(a) first layer of electrically insulating material;
(b) a second layer of electrically insulating material;
(c) an electrical conductor layer having a conductor pattern and positioned between said first and second insulating layers;
(d) a third layer of electrically insulating material; and,
(e) a layer of permanently magnetized material positioned between said second and third insulating layers; and a frame for supporting said diaphragm.

16. The transducer of claim 15 wherein said frame has a first portion charged to a first magnetic polarity.

17. The transducer of claim 15 wherein said diaphragm further includes at least one of a convex or concave region.

18. The transducer of claim 15 wherein said diaphragm further includes a plurality of said insulating layers, said electrical conductor layers and said layers of permanently magnetized material to form a multilayered diaphragm.

19. The transducer of claim 15 further comprising a control device coupled to said diaphragm for controlling operation of the transducer.

20. An electroacoustic transducer comprising:

a plurality of flexible diaphragms disposed in an array, each of said diaphragms of unique frequency response and having:
(a) first layer of electrically insulating material;
(b) a second layer of electrically insulating material;
(c) an electrical conductor layer having a conductor pattern and positioned between said first and second insulating layers;
(d) a third layer of electrically insulating material; and,
(e) a layer of permanently magnetized material positioned between said second and third insulating layers; and a frame for supporting said plurality of flexible diaphragms.

21. An electroacoustic transducer comprising:

a plurality of flexible diaphragms disposed in an array, each of said diaphragms of unique frequency response, connected to a control device and having:
(a) first layer of electrically insulating material;
(b) a second layer of electrically insulating material;
(c) an electrical conductor layer having a conductor pattern and positioned between said first and second insulating layers;
(d) a third layer of electrically insulating material; and,
(e) a layer of permanently magnetized material positioned between said second and third insulating layers; and a frame for supporting said plurality of flexible diaphragms.

22. A method for constructing an electroacoustic transducer comprising the steps of:

(a) forming a flexible diaphragm by:
forming a first layer of electrically insulating material;
forming a second layer of electrically insulating material;
forming an electrical conductor layer having a conductor pattern between said first and second insulating layers;
forming a third layer of electrically insulating material; and
forming a layer of permanently magnetized material between said second and third insulating layers;
(b) placing said diaphragm in a frame; and
(c) permanently charging at least a first portion of said frame to a first magnetic polarity.

23. A method for constructing an electroacoustic transducer comprising the steps of:

(a) forming a flexible diaphragm by forming both an electrical conductor pattern of conductive metal and a pattern of permanently magnetized material on a layer of electrically insulating material;
(b) placing said diaphragm in a frame; and
(c) permanently charging at least a first portion of said frame to a first magnetic polarity.

24. An antenna comprising:

a flexible diaphragm having:
(a) a first layer of electrically insulating material; and
(b) an electrical conductor layer attached to said first layer of electrically insulating material which incorporates both a conductor pattern and permanently magnetized material; and a frame for supporting said diaphragm.

25. An electroacoustic transducer comprising:

a flexible diaphragm having:
(a) a first layer of electrically insulating material; and
(b) an electrical conductor layer, attached to said first layer of electrically insulating material, which incorporates both permanently magnetized material and a conductor pattern including a plurality of independently addressable coils which are connected in parallel to a plurality of signal sources; and a frame for supporting said diaphragm.

26. The transducer of claim 25 wherein the plurality of signal sources correspond to the bit components of a digital signal.

* * * * *